US005664794A

United States Patent [19]

Mitchell et al.

[11] Patent Number: 5,664,794

[45] Date of Patent: *Sep. 9, 1997

[54] GROUND ENGAGING MOVABLE SKATE BRAKE

[75] Inventors: David N. Mitchell, Englewood; Bob Bromley, Louisville, both of Colo.

[73] Assignee: Out of Line Sports, Inc., Englewood, Colo.

[ * ] Notice: The term of this patent shall not extend beyond the expiration date of Pat. No. 5,316,325.

[21] Appl. No.: 535,326

[22] Filed: Sep. 27, 1995

Related U.S. Application Data

[63] Continuation of Ser. No. 295,473, Aug. 24, 1994, abandoned, which is a continuation of Ser. No. 62,407, May 14, 1993, abandoned, which is a continuation-in-part of Ser. No. 830,609, Feb. 4, 1992, Pat. No. 5,211,409, which is a continuation-in-part of Ser. No. 934,166, Aug. 24, 1992, Pat. No. 5,253,882.

[51] Int. Cl.[6] ..... A63C 17/14

[52] U.S. Cl. ..... 280/11.2; 188/5; 280/11.22

[58] Field of Search ..... 280/11.19, 11.2, 280/11.21, 11.23, 87.041, 87.042; 188/5, 6, 7

[56] References Cited

U.S. PATENT DOCUMENTS

| | | |
|---|---|---|
| 26,414 | 11/1859 | Napier . |
| 225,361 | 3/1880 | French . |
| 920,848 | 5/1909 | Eubank . |
| 922,774 | 5/1909 | Kennedy . |
| 926,646 | 6/1909 | Eubank . |
| 979,169 | 12/1910 | Kennedy . |
| 1,371,623 | 3/1921 | Ickenroth . |
| 1,402,010 | 1/1922 | Ormiston . |

(List continued on next page.)

FOREIGN PATENT DOCUMENTS

| | | |
|---|---|---|
| 330043 | 10/1976 | Austria . |
| 2055565 | 5/1992 | Canada . |
| 0 243 560-A1 | 12/1986 | European Pat. Off. . |
| 379906 | 8/1990 | European Pat. Off. . |
| 0 379 906 A3 | 8/1990 | European Pat. Off. . |
| 0 471 645 A3 | 2/1992 | European Pat. Off. . |
| 0567948A1 | 11/1993 | European Pat. Off. . |
| 0568878A1 | 11/1993 | European Pat. Off. . |

(List continued on next page.)

OTHER PUBLICATIONS

Transcript of the Deposition of David N. Mitchell, Sr., pp. 94–125.

Transcript of the Deposition of the Ivan Histand, pp. 36–46.

Transcript of the Oct. 10, 1994, Hearing In Out Of Line Sports, Inc. v. Rollerblade, Inc., Civil Action No. 94–Z–1284, District of Colorado.

Defendant's Motion To Dismiss Or Alternatively Stay This Action.

Declaration Of Paul E. Lacy In Support Of Rollerblade's Motion To Dismiss Or Alternatively Stay This Action.

Plaintiff's Corrected Opposition To Defendant's Motion To Dismiss Or Alternatively Stay This Action.

(List continued on next page.)

*Primary Examiner*—Eric D. Culbreth

*Attorney, Agent, or Firm*—Townsend and Townsend and Crew

[57] ABSTRACT

A ground engaging movable skate brake brings a brake surface into contact with the ground by moving the brake surface independently of the skate. The skate brake system of this invention includes: a delivery mechanism for driving a brake surface to the ground; a variable force mechanism for providing an increased mechanical advantage to the delivery mechanism or otherwise enhancing the performance of the system; an arresting mechanism to provide an emergency back-up in the event that the delivery mechanism should fail; a brake surface driven to the ground by the delivery mechanism; and an actuator mechanism for activating the delivery mechanism. Using the ground engaging movable skate brake, a skater need not perform any special body movement to bring the brake surface to the ground. The angle of the skate relative to the ground remains constant while the brake is applied.

24 Claims, 12 Drawing Sheets

U.S. PATENT DOCUMENTS

| | | | |
|---|---|---|---|
| 1,456,881 | 5/1923 | Carley . | |
| 1,497,224 | 6/1924 | Ormiston . | |
| 1,524,286 | 1/1925 | Bried . | |
| 1,687,739 | 10/1928 | Slusher . | |
| 1,801,205 | 4/1931 | Mirick . | |
| 2,027,487 | 1/1936 | Means . | |
| 2,179,592 | 11/1939 | Goettie | 280/11.2 |
| 2,208,888 | 7/1940 | Whited | 280/11.2 |
| 2,872,201 | 2/1959 | Wagers | 280/11.2 |
| 3,112,119 | 11/1963 | Sweet . | |
| 3,224,785 | 12/1965 | Stevenson | 280/11.2 |
| 3,339,936 | 9/1967 | Hamlin | 280/11.2 |
| 3,528,672 | 9/1970 | Wunder . | |
| 3,767,220 | 10/1973 | Peterson . | |
| 3,844,574 | 10/1974 | Kosono et al. . | |
| 3,904,215 | 9/1975 | Bardy . | |
| 4,003,582 | 1/1977 | Maurer . | |
| 4,033,596 | 7/1977 | Andorsen et al. . | |
| 4,054,296 | 10/1977 | Sullins . | |
| 4,061,348 | 12/1977 | Carter . | |
| 4,076,266 | 2/1978 | Krausz . | |
| 4,088,334 | 5/1978 | Johnson . | |
| 4,094,524 | 6/1978 | Carroll . | |
| 4,099,734 | 7/1978 | Lowery . | |
| 4,108,451 | 8/1978 | Scheck, Sr. . | |
| 4,167,225 | 9/1979 | Fragoso | 280/11.2 |
| 4,168,076 | 9/1979 | Johnson | 280/11.2 |
| 4,183,546 | 1/1980 | Heilig | 280/87.04 |
| 4,194,751 | 3/1980 | Shinmura | 280/11.2 |
| 4,275,895 | 6/1981 | Edwards | 280/11.2 |
| 4,295,547 | 10/1981 | Dungan . | |
| 4,300,781 | 11/1981 | Riggs | 280/11.2 |
| 4,363,493 | 12/1982 | Veneklasen . | |
| 4,417,737 | 11/1983 | Suroff | 280/11.115 |
| 4,453,726 | 6/1984 | Ziegler . | |
| 4,805,936 | 2/1989 | Krantz | 280/842 |
| 4,807,893 | 2/1989 | Huang . | |
| 4,817,974 | 4/1989 | Bergeron | 280/11.2 |
| 4,838,564 | 6/1989 | Jarvia | 280/11.28 |
| 4,892,332 | 1/1990 | Jennings | 280/842 |
| 4,909,523 | 3/1990 | Olson | 280/11.2 |
| 4,943,072 | 7/1990 | Henig | 280/112 |
| 4,943,075 | 7/1990 | Gates . | |
| 4,951,958 | 8/1990 | Chao . | |
| 5,028,058 | 7/1991 | Olson | 280/11.22 |
| 5,048,848 | 9/1991 | Olson et al. | 280/11.22 |
| 5,052,701 | 10/1991 | Olson . | |
| 5,068,956 | 12/1991 | Malewicz . | |
| 5,088,748 | 2/1992 | Koselka et al. . | |
| 5,098,087 | 3/1992 | Matile et al. | 280/87.021 |
| 5,118,122 | 6/1992 | Ricart | 280/11.2 |
| 5,171,032 | 12/1992 | Dettmer | 280/11.2 |
| 5,183,275 | 2/1993 | Hoskin | 280/11.2 |
| 5,192,099 | 3/1993 | Riutta | 280/11.2 |
| 5,211,409 | 5/1993 | Mitchell et al. | 280/11.2 |
| 5,226,673 | 7/1993 | Cech | 280/11.2 |
| 5,253,882 | 10/1993 | Mitchell . | |
| 5,280,930 | 1/1994 | Smathers et al. | 280/11.2 |
| 5,280,931 | 1/1994 | Horton | 280/11.2 |
| 5,299,815 | 4/1994 | Brosnan et al. | 280/11.2 |
| 5,316,325 | 5/1994 | Mitchell et al. . | |
| 5,330,207 | 7/1994 | Mitchell . | |
| 5,465,984 | 11/1995 | Pellegrini, Jr. et al. | 280/11.2 |
| 5,564,718 | 10/1996 | Mitchell et al. | 280/11.2 |

FOREIGN PATENT DOCUMENTS

| | | |
|---|---|---|
| 2 627 995-A1 | 3/1988 | France . |
| 2 670 125-A1 | 12/1990 | France . |
| 223485 | 11/1908 | Germany . |
| 230621 | 6/1910 | Germany . |
| 386288 | 12/1922 | Germany . |
| 438462 | 1/1925 | Germany . |
| 952693 | 5/1956 | Germany . |
| 330 043 | 6/1976 | Germany . |
| 25 37 778 A1 | 3/1977 | Germany . |
| 27 23 107 | 5/1977 | Germany . |
| 2723107 | 11/1978 | Germany . |
| 29 25 555 | 6/1979 | Germany . |
| 63-8073 | of 1988 | Japan . |
| 104127 | 5/1923 | Switzerland . |
| 104127 | 4/1924 | Switzerland . |
| WO89/03712 | 5/1989 | WIPO . |

OTHER PUBLICATIONS

Declaration of Dale Niggemann, *Mitchell v. Niggeman,* in the United States Patent and Trademark Office before the Board of Patent Appeals and Interferences, Interference No. 103,666.

Declaration of Susan Niggemann, *Mitchell v. Niggeman,* in the United States Patent and Trademark Office before The Board of Patent Appeals and Interferences, Interference No. 103,666.

Declaration of Michael Cichanowski, *Mitchell v. Niggeman,* in the United States Patent and Trademark Office before the Board of Patent Appeals and Interferences, Interference No. 103,666.

"Stop Roller Skiing—Local Inventor Has Developed A Roller Ski With A Brake—And It Actually Works" by Lee Borowski, Published in Silent Sports, Nov. 1991.

"Roller Ski with Confidence" Advertisement Published in Silent Sports, Oct.–Nov. 1991.

Deposition of Dale Allen Niggeman, Oct. 11, 1994, pp. 41–44, 149–152, 113–124, and Exhibit 3, *Out of Line Sports, Inc. v. Rollerblade, Inc.,* Civil Action No. 94–Z–1284, Dist. Ct. of Colo.

GROUND ENGAGING MOVABLE SKATE BRAKE

CROSS-REFERENCE TO RELATED APPLICATIONS

This is a continuation of application Ser. No. 08/295,473 (filed Aug. 24, 1994, abandoned), which is a continuation of application Ser. No. 08/062,407 (filed May 14, 1993, abandoned), which is a continuation-in-part of application Ser. No. 07/830,609 (filed Feb. 4, 1992, now U.S. Pat. No. 5,211,409), which it turn is a continuation-in-part of application Ser. No. 07/934,166 (filed Aug. 24, 1992, now U.S. Pat. No. 5,253,882).

FIELD OF THE INVENTION

This invention relates to roller skate brakes, and more particularly to a roller skate brake which is remotely activated and stops the skate by applying friction to the ground rather than to a wheel of the skate. The invention has particular utility for use with "inline" skates and other modern skates that attain high speeds and are used in areas with pedestrians, automobiles and other hazards.

BACKGROUND OF THE INVENTION

Traditional roller skates, having sets of wheels in tandem, have long been used in the relatively controlled environment of a skating rink. In a skating rink, the skating surface is typically flat and smooth, skaters travel in the same direction around an oval or circular track, and there are few unexpected hazards. There has been, therefore, little need for an effective brake on a traditional roller skate.

Relatively recently, a faster and more maneuverable type of roller skate has been introduced. These skates, known as "inline" skates because the wheels are mounted in a line rather than in tandem, act much as an ice skate. Inline skates are offered in the United States by several vendors, including Rollerblade, Veraflex, Bauer, California Pro, and Hyper Wheels. Inline skates have appealed to the athletic adult and young adult, and to persons who enjoy the outdoors. Such skates are commonly used outside, on uneven sidewalks, bicycle paths, and roads. Skaters can achieve high speeds and can become a hazard to themselves and others when skating more rapidly than conditions allow. There is a need for an effective brake for inline skating to become a sport that is safe as well as enjoyable.

A brake commonly used on inline skates involves a fixed friction pad that extends behind the heel of the skate. The fixed friction pad is disposed above the skating surface and is made to swing down towards the skating surface by the skater's pivoting the skate about the axis of the rear wheel. As the skater does so, raising the toe of the skate and rotating the heel downward, the friction pad behind the heel will contact the ground and stop the skate. Such systems have also been used on tandem wheeled skates, and, because the speeds are not so high, can involve a fixed friction pad that extends in front of the toe of the skate. In this case, the skater brings the friction pad to bear on the skating surface by raising the heel and lowering the toe.

Examples of these physically activated (toe-raised, or toe-lowered) brakes include those described in U.S. Pat. Nos. 2,901,259 (tandem wheeled skates, brake member in the toe section, braking performed by lowering the toe); 4,313,610 of Volk (a friction-damped wheel in the heel section, braking performed by raising the toe); 4,865,342 of Kong (for a skate board). The adaptation of such a brake for use with an inline skate is shown in U.S. Pat. Nos. 4,394,028 of Wheelwright; 4,418,929 of Gray; 4,909,523 of Olson; 5,052,701 of Olson; and 5,067,736 of Olson.

Disadvantages of the physically activated, toe-raised (or lowered), brakes include these: (a) the braking maneuver requires the exercise of thigh muscle strength, and a skater's fatigue will make the maneuver more difficult to perform, (b) the braking maneuver requires the skater to place himself or herself in an awkward position, and a skater's lack of dexterity or balance will make the maneuver difficult to perform, especially if the skater is moving at relatively high speed or encounters an unexpected hazard, and (c) such brakes can only be used on one skate, effectively halving the potential stopping force available.

It may be said, in general, that an inexperienced skater finds it very intimidating to move his or her foot through such a large arc that he or she must jeopardize their balance in order to apply the brake. This has made many potentially new skaters reluctant to take up the sport at all.

There has been much interest in attempting to solve the problems of toe-raised (or lowered) brakes so as to make inline skating a sport that can be enjoyed by other than the young, the fit, or the reckless. Current attempts to do so have been directed towards replacing the physically-activated brake with a remotely activated device. There have been attempts to mount a caliper or disc brake adjacent to the side or tread of one of the wheels of the skate. A hand lever-and-cable system can be used by the skater to apply friction pressure to the side or to the tread of the wheel, and the skate can be made to stop without the need for special body movement by a skater.

Examples of these remotely activated (wheel based) brakes include those described in U.S. Pat. Nos. 4,295,547 of Dungan; 4,312,514 of Horowitz et al.; 4,943,075 of Gates; and 4,943,072 of Henig.

Disadvantages of trying to use the wheel of an inline skate for stopping include these: (a) the amount of contact that a wheel can have with the skating surface is very small when compared to the amount of contact that a friction pad behind the skate could have, (b) because inline skate wheels encounter considerable wear, and the wear is uneven, it is possible that the wheel selected for braking may have little, or no, contact with the ground, (c) heat generated by the rubbing of a brake pad on the wheel may cause the wheel to break down and fall apart, (d) the wheel selected for braking may develop flat spots and cause rough skating, and (e) the replacement cost of a skate wheel is high compared to the cost of replacing a friction pad behind the skate.

Thus, there are two general kinds of brake systems currently available. The first kind of brake stops the skate by using a physical maneuver to bring a pad into contact with the skating surface (toe-raised or toe-lowered brakes). The second kind of brake stops the skate by using a remotely activated device to bring a pad into contact with a wheel of the skate (wheel-based brakes).

There are also some composite brakes, in which a physical maneuver is used both to bring a pad into contact with the skating surface and to bring another pad into contact with a wheel of the skate. Examples are described in U.S. Pat. No. 4,807,893 of Huang (brake member in the heel section, braking performed by depressing the heel); and in U.S. Pat. No. 4,453,726 of Ziegler. Composite brakes of this kind still fall into the general category of toe-raised or toe-lowered brakes and share all of the previously discussed disadvantage of the physically activated brake.

Despite the work which has been done to develop an optimum inline skate brake, each of the existing brakes has problems. Either they are difficult to use (that is, the physically activated, toe-raised or toe-lowered brakes), or they offer relatively small effective stopping force (that is, the mechanically activated, wheel-based brakes). Accordingly, it can be seen that there is a need for an inline skate brake that better meets the needs of a skater.

The desired inline skate brake should have a relatively large effective area in contact with the skating surface so as to maximize the effective stopping power of the brake. In addition, the desired inline skate brake should permit an independent selection of the material for the portion that is in effective contact with the skating surface. That is, this important portion of the brake assembly should be selected without regard to factors other than its effectiveness (durability, coefficient of friction, and so on) for stopping the skate. These concerns suggest that the desired brake will not be a wheel-based brake in which the only area in contact with the ground is the wheel and in which the material in effective contact with the ground must be the same material as is used in the wheel itself.

The desired inline skate brake should be capable of being fitted to both skates, rather to just one skate, so as to double the effective braking surface area in contact with the skating surface. In addition, the desired inline skate brake should use the skater's hand, rather than his or her foot or leg, to activate the movement of the braking pad. Using the hand to activate the brake will allow the skater to use his or her total body, including hands, to maintain good balance at all times, including times when the skater needs to slow down or stop and when the need for balance may be greatest. These concerns suggest that the desired brake will not be a toe-raised or toe-lowered brake.

In addition, the desired inline skate brake should be capable of being retrofitted to most existing skates and should be capable of being installed as original equipment by skate manufacturers at reasonable cost. If the skate brake is mechanically activated, it should have a secondary, or "emergency," brake that can be used in the event of mechanical failure of the primary activator. If a cable-and-hand-lever activator is used, it should have some means for conveniently retaining the cables and hand levers.

It is a specific object of the current invention to provide a brake system that is remotely activated, that uses the skating surface (rather than a wheel of the skate) for generating stopping force while the angle of the skate relative to the ground remains constant, that has a large effective area in contact with the skating surface, that can be fitted to both skates, that allows for an independent selection of the material in contact with the braking surface, that incorporates an emergency brake, that can be readily installed in new or used skates, and that conveniently retains all cables and hand-levers which are a part of the system. These, and other advantages, of the brake system of this invention will become apparent in the remainder of this disclosure.

U.S. patent application Ser. No. 07/830,609 (of which this is a continuation-in-part) discloses a hand-activated brake system that accomplishes the foregoing objects and which describes a brake delivery mechanism including a rocker arm. U.S. patent application Ser. No. 07/934,166 (of which this is also a continuation-in-part) discloses two other brake delivery mechanisms: one that includes a wrap around brake carriage; and another that includes a plunger.

The present invention discloses additional brake delivery mechanisms, including a side rail mechanism and an integrated mechanism. The present invention also discloses various other embodiments, improvements and refinements of the skate brake systems described, and it also discloses a method of fitting the brake systems to an inline skate.

Although the devices of this disclosure are directed towards the newer "inline" skates, it should be understood that the brake systems of this invention may be readily adapted to the traditional tandem skates, skate boards, ski skates, and to other skating devices.

SUMMARY OF THE INVENTION

The brake system of this invention is most broadly characterized as being (a) ground engaging, and (b) movable. That is to say, the brake system encases the ground so as to use the ground (rather than a wheel of the skate) for generating stopping force. Further, a delivery mechanism of the brake system moves relative to the skate so as to drive a braking surface to the ground while the angle of the skate relative to the ground remains constant.

The brake system of this invention brings a brake surface into contact with the ground by moving the brake surface independently of the skate. All of the separate embodiments disclosed herein share those common features.

In summary, the ground engaging movable brake system of this invention includes the following basic component elements: (1) a delivery mechanism for driving a brake surface to the ground; (2) a variable force mechanism for providing an increased mechanical advantage to the delivery mechanism or otherwise enhancing the performance of the system; (3) an arresting mechanism to provide an emergency back-up in the event that the delivery mechanism should fail; (4) a brake surface driven to the ground by the delivery mechanism; and (5) an actuator mechanism for activating the delivery mechanism. As will be seen, each of the various component elements will be described in several embodiments, and complete brake systems combining certain of the elements will be described in such a way that other combinations of the elements will become clear to those skilled in the art.

The delivery mechanism of this invention is the device that drives the brake surface to the ground. Five embodiments of the delivery mechanism will be referred to as: (a) a rocker arm, (b) a carriage, (c) a plunger, (d) a side rail, and (e) an integrated unit.

The variable force mechanism of this invention enhances the operation of the delivery mechanism. Among the specific embodiments of the variable force mechanism discussed herein are ones that incorporate a lever, a cam, a pulley, and/or a worm gear.

The arresting mechanism provides an emergency back-up in the event that the delivery mechanism should fail. The most basic version of the arresting mechanism is a post disposed in the path of the delivery mechanism to lock the delivery mechanism in place so as to duplicate the action of a conventional toe-raised brake for emergency stopping. Several ways of incorporating the arresting mechanism will be discussed.

The brake surface of the system of this invention is the element which is driven to the ground by the delivery mechanism. The most basic version of the brake surface is a pad, but other embodiments, including a friction-damped wheel or an eccentric/round braking surface, will be discussed.

The actuator mechanism is used to activate the delivery mechanism. Various versions of the actuator mechanism, with cables or with wireless components, and including a specially designed hand control, will be discussed.

Finally, and of no less importance, a method of fitting the brake system of this invention to inline skates, including both newly manufactured skates and existing skates, is disclosed. An important condition to achieving the advantages of the brake system of this invention is, of course, that the system must be capable of practical installation in an inline skate. Indeed, without a practical way either to retrofit existing skates or to fit newly manufactured skates, the objects of this invention would never be realized by skaters. Because of specific characteristics of this invention, a method for fitting the brake system disclosed herein both to existing inline skates and to newly manufactured skates can be devised, and is disclosed as part of this invention.

For purposes of this summary, the most basic features of the various delivery mechanisms will be pointed out. Further details of the delivery mechanisms, and of the various other components of the brake system, will be provided in the detailed description.

The most basic version of the "carriage" delivery mechanism of this invention includes a carriage that pivots about the rear of a skate so as to bring a brake surface into contact with the ground when the carriage is activated. The carriage is hand-activated so that the skater need not perform any special body movement so as to raise (or lower) the toe of the skate. Accordingly, the angle of the skate relative to the ground remains constant while the brake is applied.

A U-shaped brake carriage may wrap around the heel of a skate, with the heel of the U being oriented to the rear so that a brake pad may be brought into contact with the skating surface behind the skate when the carriage is activated. The open end of the U-shaped carriage may face towards the front of the skate, and the closed end may extend outwards behind the heel of the skate.

In one mode (for easy retrofit to existing skates) the brake carriage is pivotably connected to the axle of the rearmost wheel of the skate. A pair of holes from one arm to the opposite point on the other arm of the U is adapted so that the brake carriage may be mounted on the axle of the wheel.

The brake surface may be a brake pad mounted on the brake carriage behind the heel of the skate. Such a brake pad may be contained within the cup of the "U" and secured by a bolt embedded in the brake pad that is attached by a nut to a mounting piece within the carriage. The pad may be further secured to the carriage by a set of complementary nipples and holes disposed in the mounting piece and the brake pad. When the brake is activated, the brake pad will swing down with the brake carriage until the pad hits the ground. When not activated, the brake pad will ride with the brake carriage above the skating surface. The brake pad may be formed of a high density molded material having a high coefficient of friction and high durability.

The arms of the brake carriage act as levers about the pivot point. A first force applied to an arm causes the brake carriage to rotate about the axle of the wheel in a first direction and drives the brake pad against the ground. A second force applied to an arm causes the brake carriage to rotate about the axle in a second direction and pulls the brake pad away from the ground.

A mechanical advantage may be obtained by mounting a variable force mechanism on the delivery mechanism. This can be done by mounting a pulley on the axle of the wheel and threading a cable around the pulley, by mounting a lever and/or cam on the carriage, or otherwise. Likewise, the other components previously referenced (the arresting mechanism, the different kinds of brake surfaces instead of a brake pad, and the actuator mechanism) may be combined.

The foregoing summary simply refers to a basic carriage delivery mechanism set in a basic brake system.

In the "rocker arm" embodiment of the delivery mechanism of the brake system, a pivoting rocker arm is used to drive a brake surface to the ground.

In the "plunger" embodiment of the delivery mechanism, there is a plunger housing mounted on a skate and containing a plunger that moves so as to bring the brake surface into contact with the ground when the plunger is activated. When the plunger housing is oriented so that the plunger axis is substantially vertical relative to the ground, a brake surface connected to the plunger will contact the ground as the plunger is lowered. Thus, in a way analogous to the other ground engaging movable brakes of this invention, a first force applied to the plunger lowers it and drives the brake surface against the ground. A second force applied to the plunger lifts it and pulls the brake surface away from the ground.

In the "side rail" embodiment of the delivery mechanism, the braking surface is mounted on a bar or rail carried to the side of skate, and the braking surface is brought into contact with the ground by movement of the bar or rail. For retrofit to existing skates, this embodiment makes use of the axles of two or more wheels.

In the "integrated" embodiment of the delivery mechanism, an existing housing of the type used on several inline skates currently available is used to hold a ground engaging moveable brake surface. A mechanism is fitted into, and integrated within, the existing housing so as to drive a brake surface against the ground.

The brake system of this invention (whether embodied with a rocker arm, carriage, plunger, side rail, or integrated delivery mechanism) is remotely activated by hand so that the skater need not perform any special body movement so as to raise (or lower) the toe of the skate.

In all embodiments, a cable-and-lever system may be used to provide the first force that drives the brake surface to the ground for stopping, and a spring may be used to provide the second force for holding the brake pad away from the ground for free skating. Easily understood variations on the cable system include wire, pneumatic, hydraulic, or electro-magnetic elements. Likewise, an easily understood variation would be to reverse the push/pull orientation of the first and second forces. In those cases where a cable or wire is used, it becomes important to retain the cable, and this invention includes a housing that can be worn by the skater as a belt.

The belt includes elastic retainers that hold the cables, and also VELCRO-brand hook and loop fasteners. The elastic retainers are intended to help guard against the cables' dragging behind the skater if the cables should be dropped. The VELCRO-brand fasteners are intended to be used with complementary fasteners on the hand-operated levers so that the skater may conveniently affix the hand levers to the belt until needed. The hand lever is designed so as to return to a closed position so that the hand lever, if dropped, will be less likely to catch on posts or other stationary objects.

The skate brake system of this invention may be used on either skate (left or right). It may also be used on both skates. When affixed to either skate, the skate brake system of this invention provides an effective surface area for the application of stopping force to the ground which is equal to or greater than that of typical toe-raised brakes, and which is substantially greater than typical wheel-based brakes. When affixed to both skates, the skate brake system of this invention can effectively double, or more than double, the stopping surface area of typical toe-raised brakes, and far exceeds the stopping surface area of the typical wheel-based brake.

In the various embodiments just summarized, a variable force mechanism, including a lever, cam, pulley, and/or worm gears may be used. So also, an arresting mechanism may be provided. The brake surface may be a brake pad, and may also be part of a friction-damped wheel. The delivery mechanism may be affixed to the skate behind the rearmost wheel, or at a point in advance of the rearmost wheel, and may use an axle of the skate or an axis parallel to an axle of the skate. These improvements and refinements are equally adaptable for use with the several of the specific delivery mechanisms.

In summary, the brake system of this invention includes a ground engaging movable brake. The brake system is remotely hand-activated, uses the skating surface (rather than a wheel of the skate) for generating stopping force while the angle of the skate relative to the ground remains constant, has a large effective area in contact with the skating surface, can be fitted to both skates, allows for an independent selection of the material in contact with the braking surface, incorporates an emergency brake, can be readily installed in new or used skates, and conveniently retains all cables and hand-levers which are a part of the system. These, and other advantages, of the brake system of this invention will become apparent in the remainder of this disclosure.

FIG, 13 is an exploded perspective view, showing an alternative embodiment of a side rail delivery mechanism of this invention.

Figure 14:
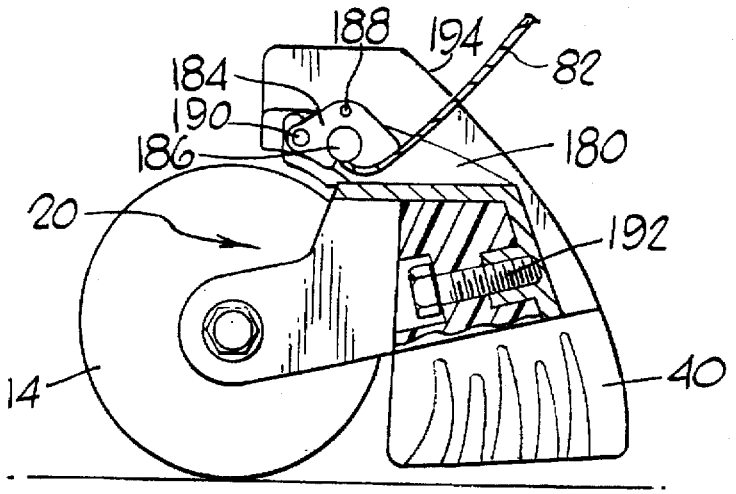

FIG. 14 is a side elevational view of a carriage embodiment of the delivery mechanism of the brake system of this invention, showing a cam and lever.

Figure 15:
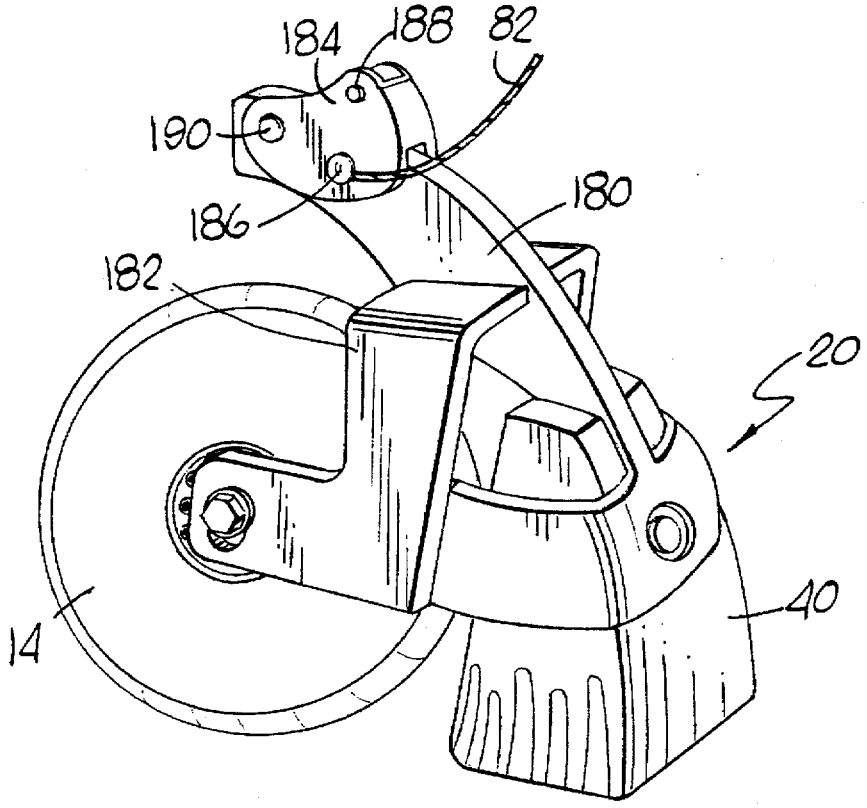

FIG. 15 is a perspective view of the carriage embodiment of FIG. 14.

Figure 16A:
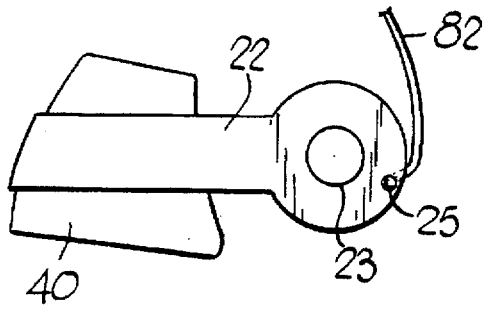
Figure 16B:
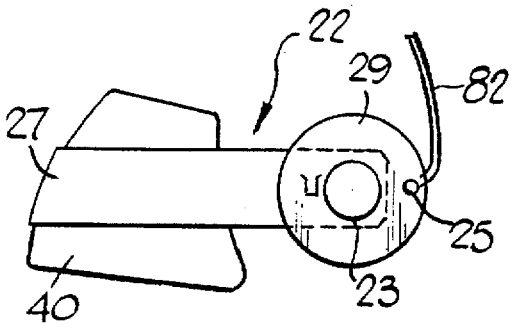
Figure 16C:
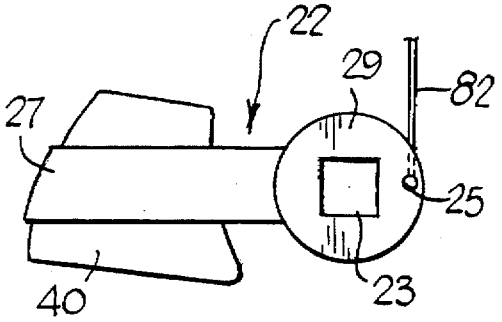
Figure 16D:
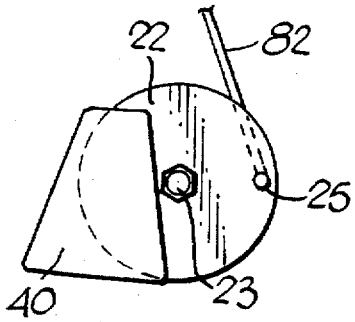
Figure 16E:
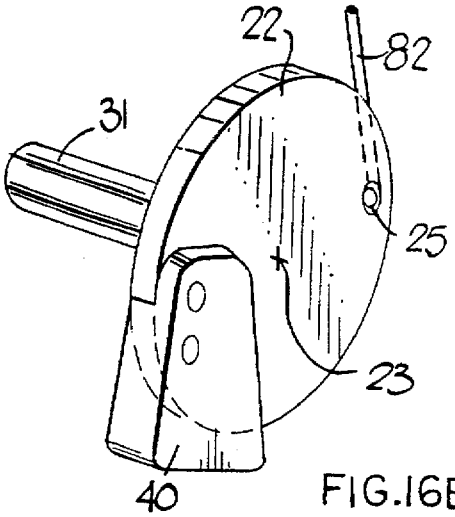

FIGS. 16A–16D are side elevational views, and FIG. 16E is a perspective view, of alternative rocker arms for use in the system of this invention.

Figure 17B:
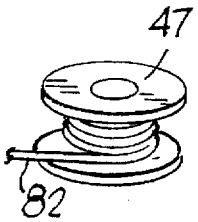
Figure 17A:
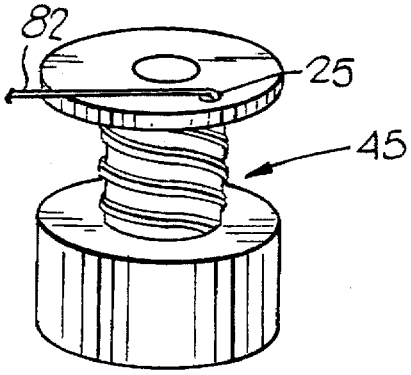

FIGS. 17A and 17B are perspective views of a worm gear and spool for use in the system of this invention.

FIGS. 18A–18G are side elevational views of alternative arresting mechanisms for use in the system of this invention.

Figure 19:
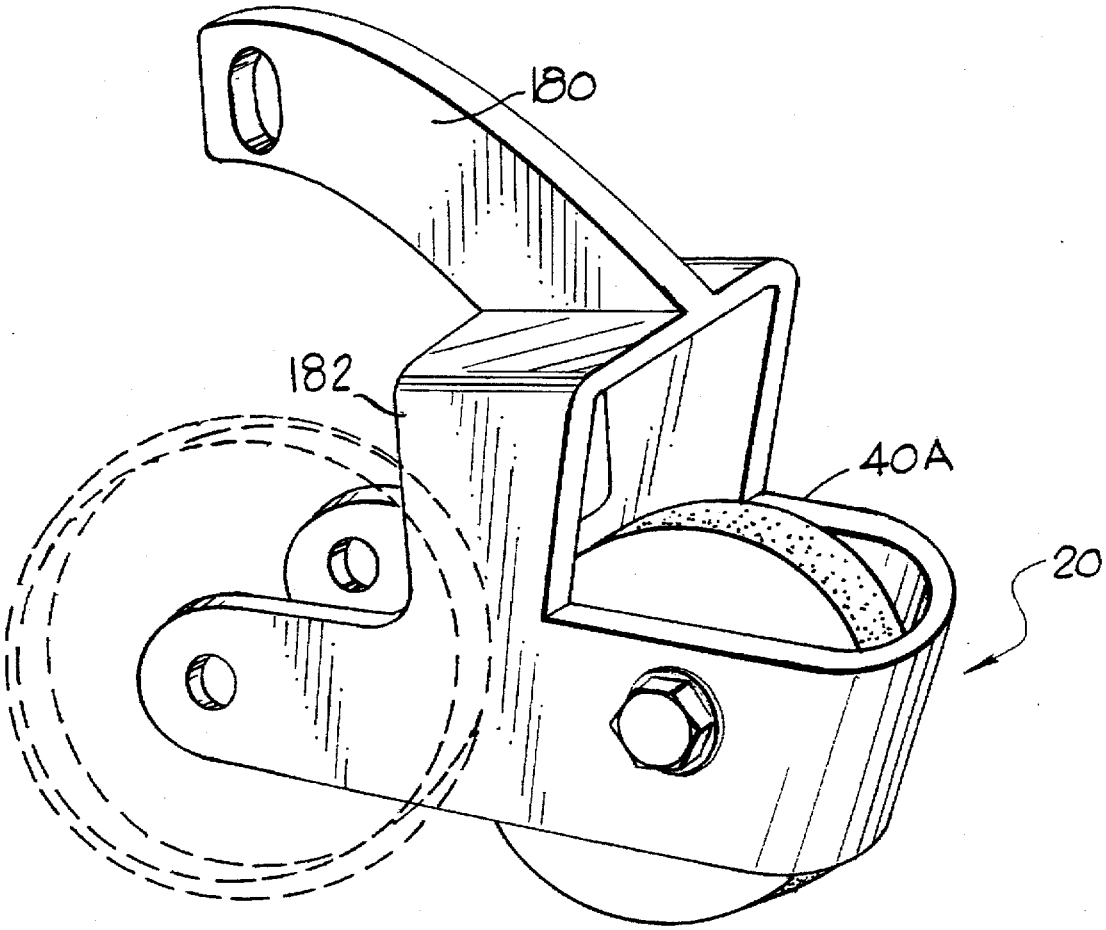

FIG. 19 is a perspective view of a friction wheel brake surface for use in the system of this invention.

Figure 20:
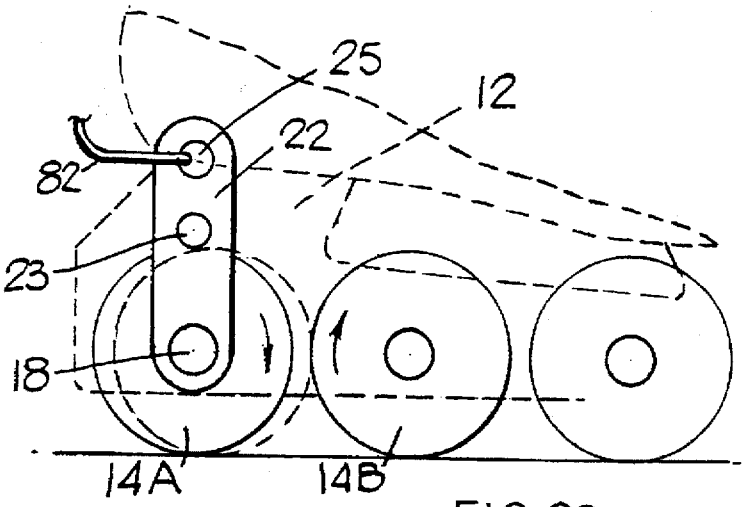

FIG. 20 is a schematic view of an alternative friction wheel for use in the system of this invention.

Figure 21:
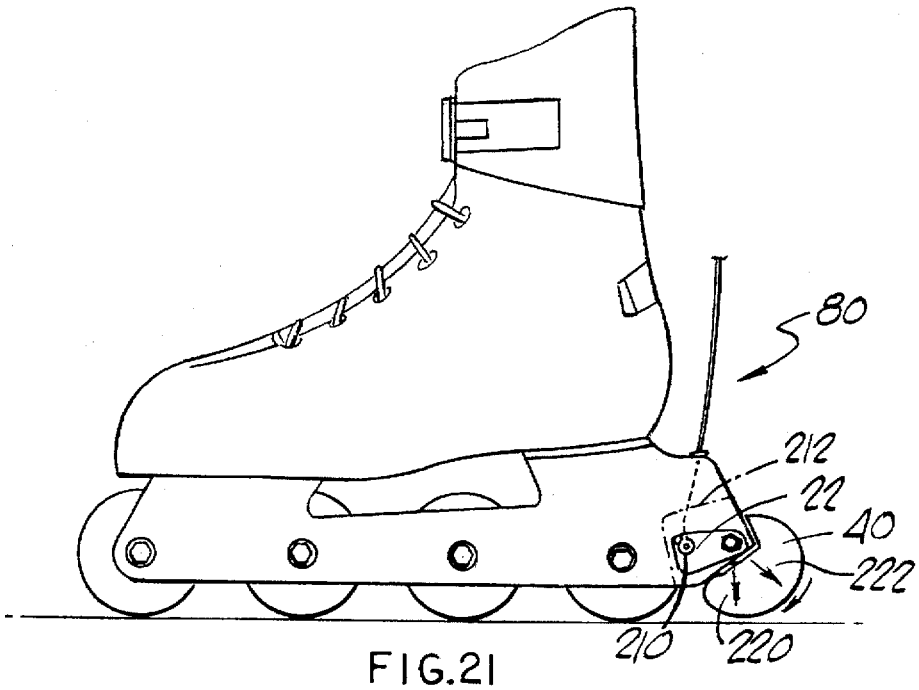

FIG. 21 is a side elevational view of an integrated embodiment of the delivery mechanism of the brake system of this invention.

Figure 22:
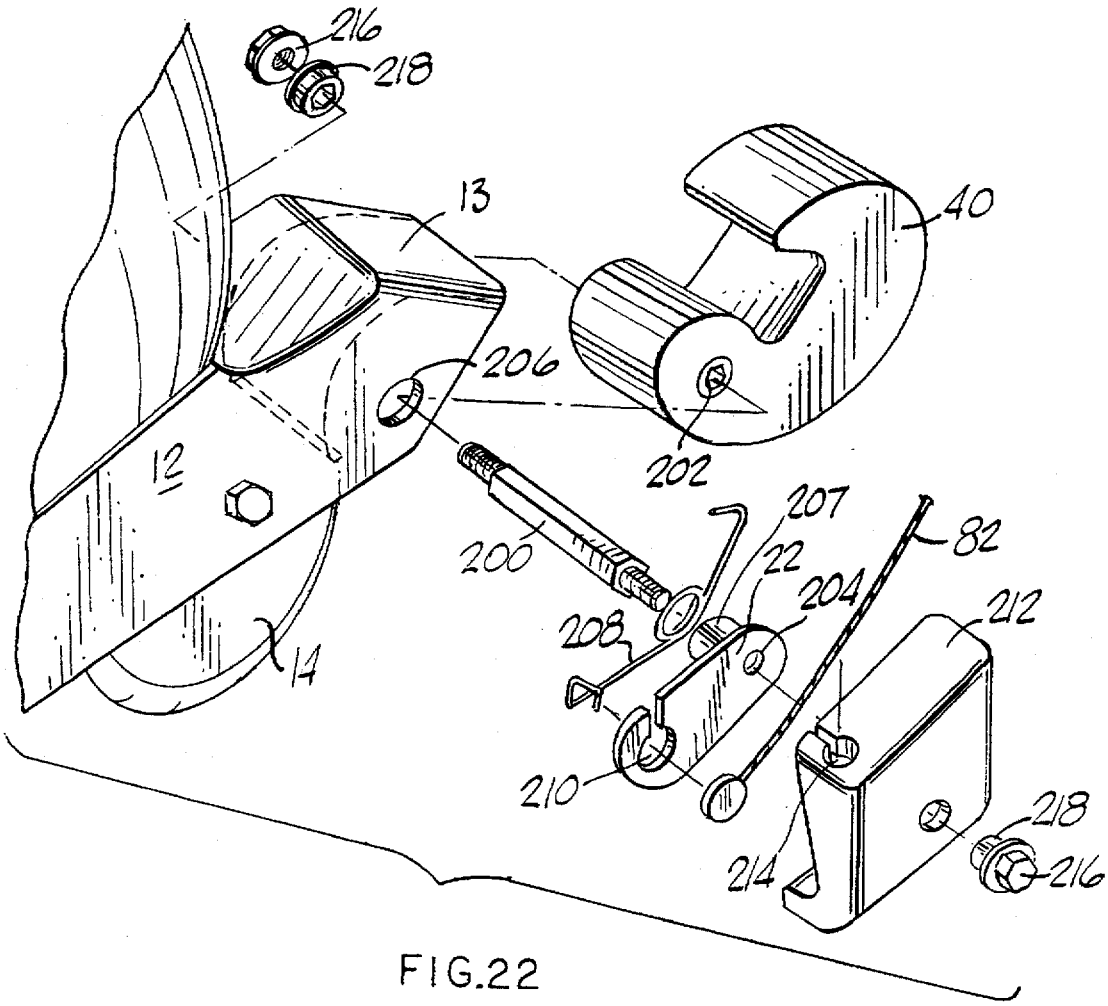

FIG. 22 is an exploded perspective view of the integrated embodiment of FIG. 21.

Figure 23:
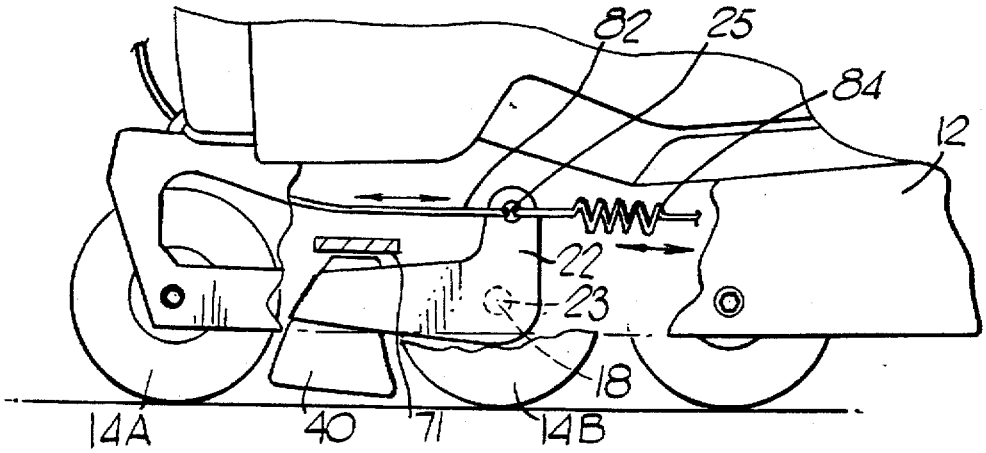

FIG. 23 is a partially cut away side elevational view of a rocker arm delivery mechanism, showing the rocker arm attached at an axle of the skate between the fourth wheel (rearmost wheel) and the third wheel of a skate.

Figure 24:
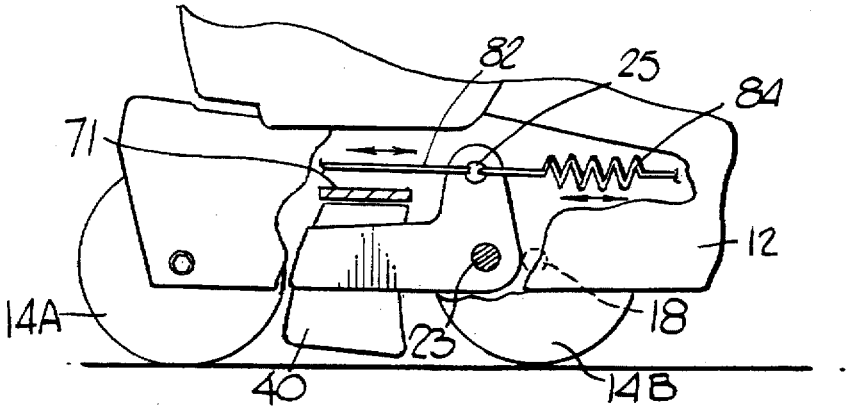

FIG. 24 is a partially cut away side elevational view of a rocker arm delivery mechanism, showing the rocker arm attached at an axis parallel to the axle of the skate between the fourth wheel (rearmost wheel) and the third wheel of a skate.

Figure 25:
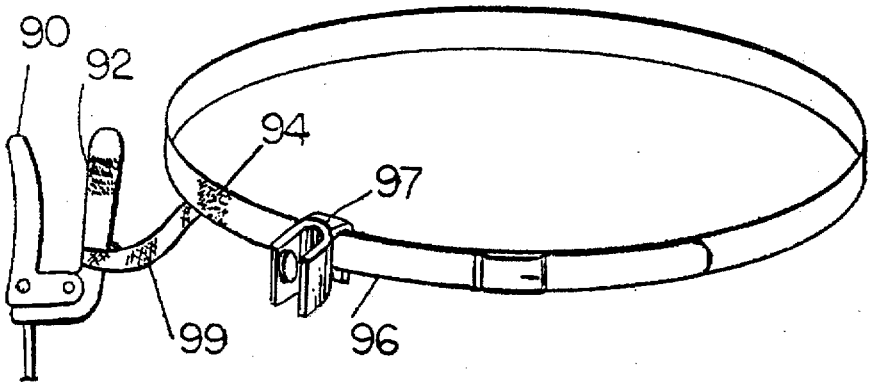

FIG. 25 is a perspective view of a belt for housing the hand-held controller(s) used to activate the brake system of this invention.

Figure 26:
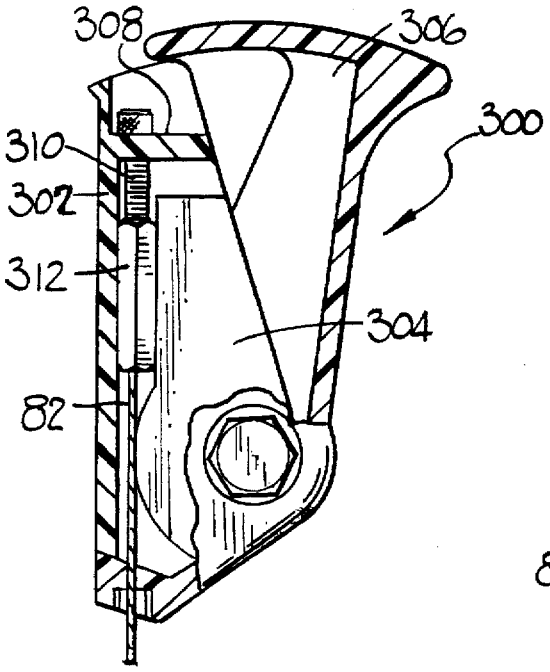

FIG. 26 is a cut away side elevational view of a preferred hand-held controller for use in the system of this invention, showing the controller in an uncompressed state.

Figure 27:
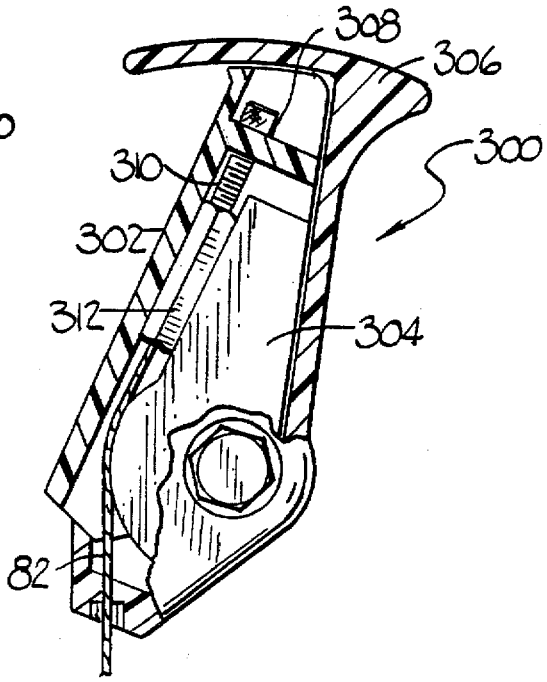

FIG. 27 is a cut away side elevational view of the controller of FIG. 26, showing the controller in a compressed state.

Figure 28:
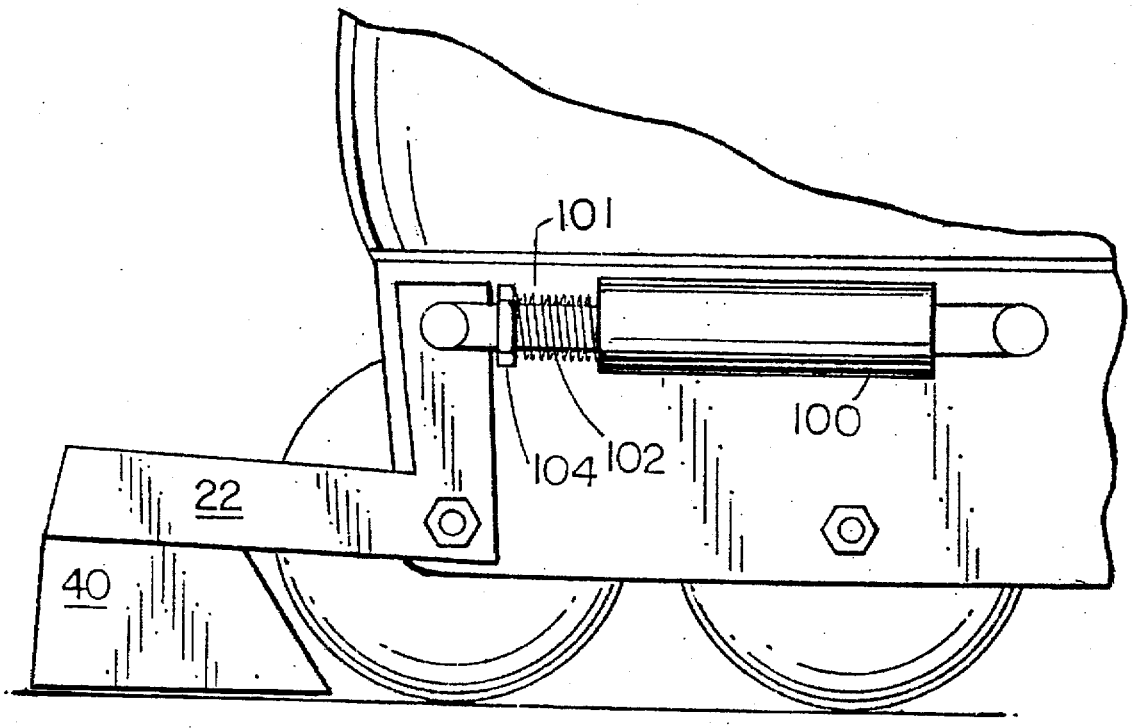

FIG. 28 is a side elevational view of the brake system of this invention showing a wireless activator.

Figure 29:
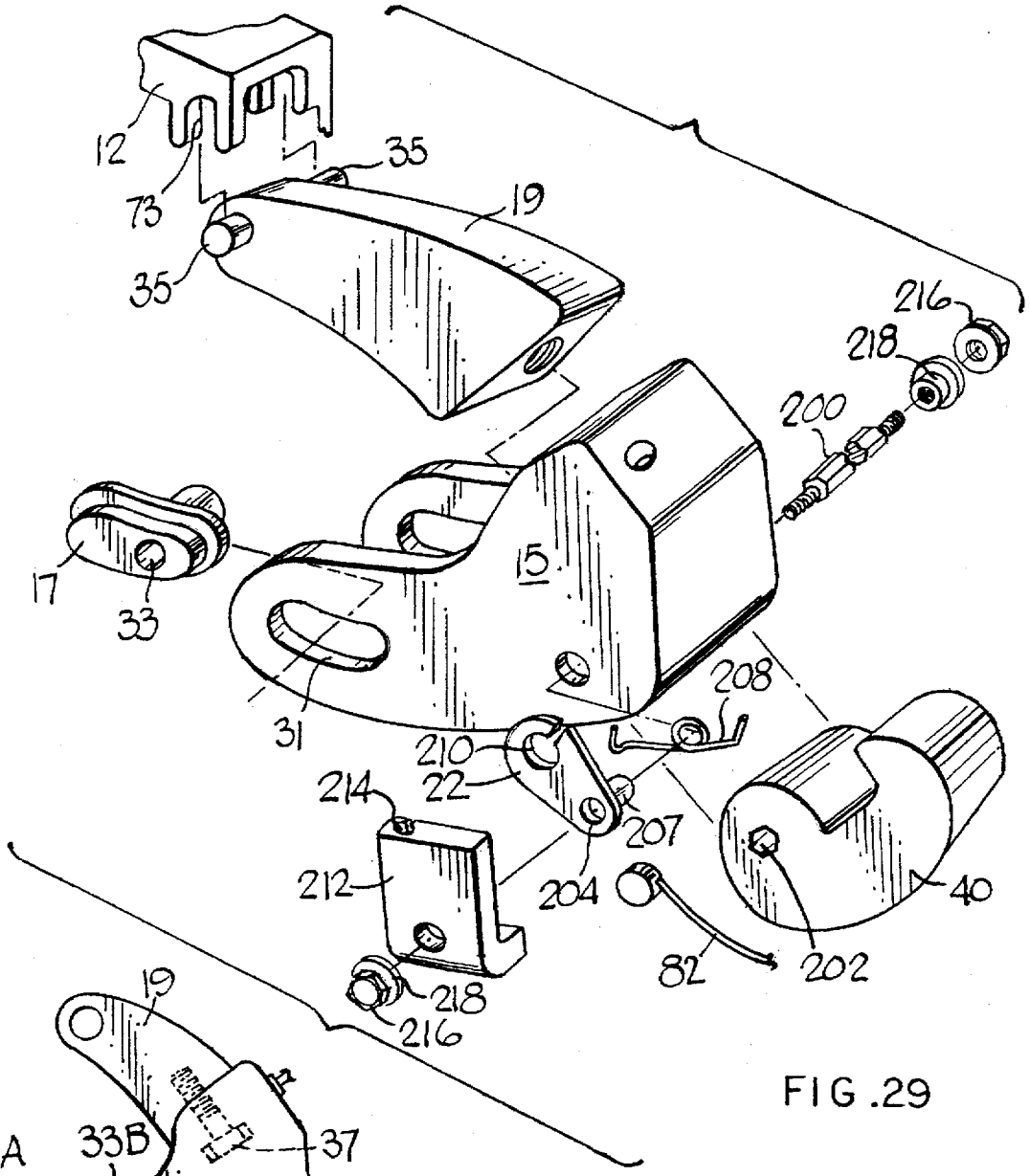

FIG. 29 is an exploded perspective view of an integrated embodiment of the delivery mechanism of the brake system of this invention, showing a modular housing with cam and support member.

Figure 30:
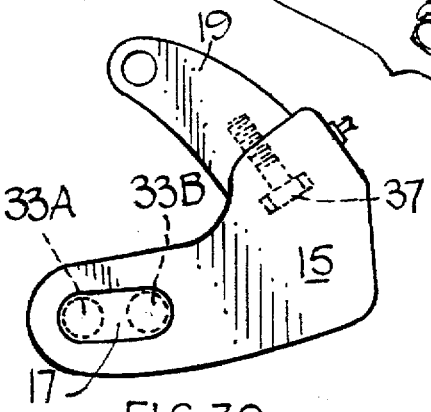

FIG. 30 is a side elevational view of the integrated delivery mechanism of FIG. 29.

Figure 31:
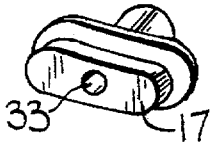

FIG. 31 is a perspective view of an alternative cam for use in the integrated delivery mechanism of FIG. 29.

Figure 32:
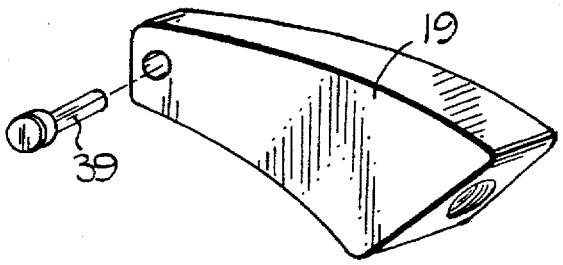

FIG. 32 is a perspective view of an alternative support for use in the integrated delivery mechanism of FIG. 29.

DETAILED DESCRIPTION OF THE INVENTION

The brake system of this invention is characterized as being ground engaging and movable so that the brake system engages the ground while a delivery mechanism of the brake system moves relative to the skate. The result is to drive a braking surface to the ground while the angle of the skate relative to the ground remains constant. Accordingly, the brake system of this invention brings a brake surface into contact with the ground by moving the brake surface independently of the skate. All of the separate embodiments disclosed herein share those common features.

In summary, the ground engaging movable brake system of this invention includes the following basic component elements: (1) a delivery mechanism for driving a brake surface to the ground; (2) a variable force mechanism for providing an increased mechanical advantage to the delivery mechanism or otherwise enhancing the performance of the system; (3) an arresting mechanism to provide an emergency back-up in the event that the delivery mechanism should fail; (4) a brake surface driven to the ground by the delivery mechanism; and (5) an actuator mechanism for activating the delivery mechanism. As will be seen, each of the various component elements will be described in several embodiments, and complete brake systems combining certain of the elements will be described in such a way that other combinations of the elements will become clear to those skilled in the art.

Each of the foregoing component elements will be discussed in turn, and in the context of a complete brake system.

BASIC DELIVERY MECHANISMS

The delivery mechanism of this invention is the device that drives the brake surface to the ground. Five embodiments of the delivery mechanism will be referred to as: (a) a rocker arm, (b) a carriage, (c) a plunger, (d) a side rail, and (e) an integrated unit. The following discussion will address each of these five delivery mechanisms.

Basic Rocker Arm Delivery Mechanism

Figure 1:
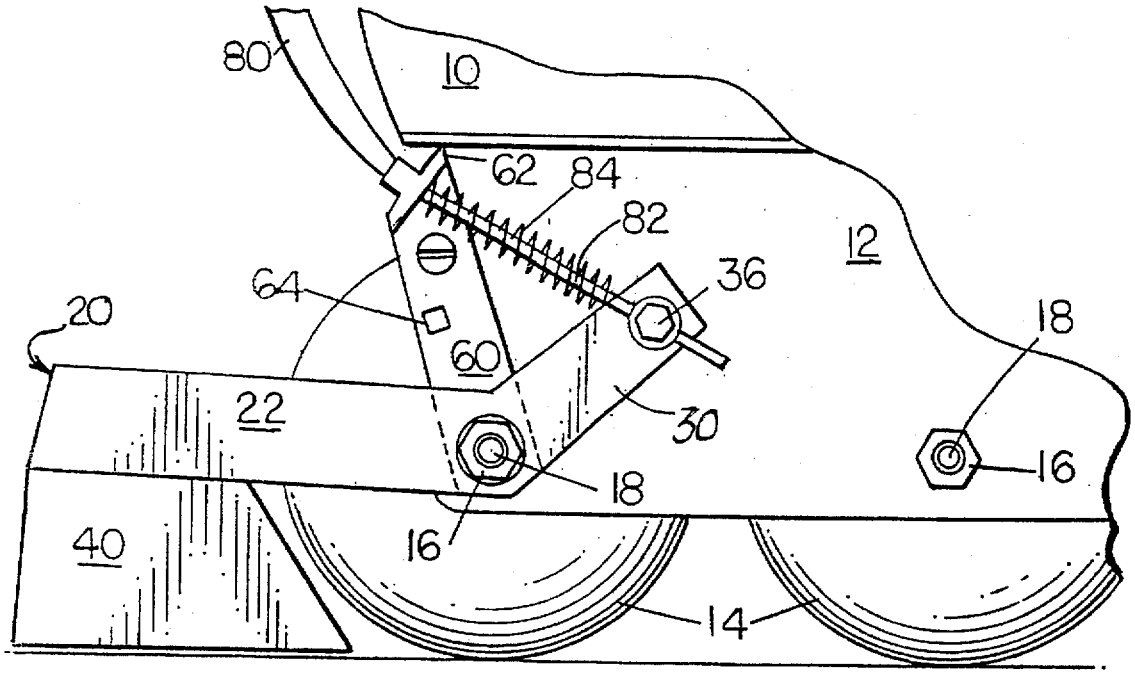
FIG. 1 is a side elevational view of a rocker arm embodiment of the delivery mechanism of the brake system of this invention.

With reference to FIG. 1, it can be seen in overview that a basic rocker arm delivery mechanism of the brake system of this invention includes: a rocker arm 22 held within a frame 20, a brake pad 40, an actuator support arm 60, and an actuator assembly 80. In this embodiment, a lever end 30 of the rocker arm 22 serves as the variable force mechanism, and an arm 64 on the actuator support arm 60 serves as the arresting mechanism. Each of these elements will be discussed individually, and with reference to FIGS. 2–5 before returning to FIG. 1 for a discussion of the elements in combination.

Figure 2:
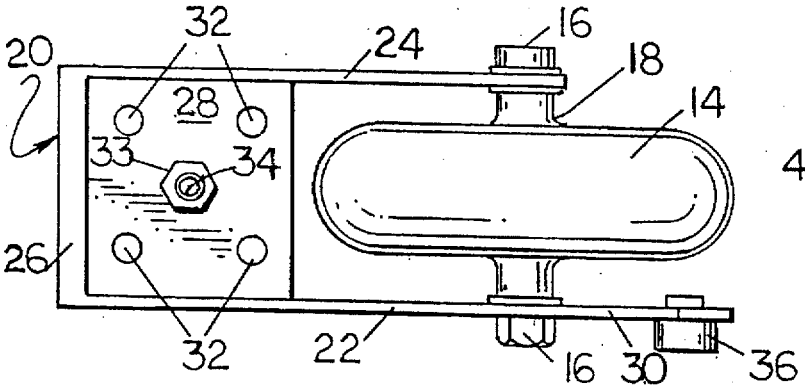
FIG. 2 is a top plan view of the rocker arm embodiment of FIG. 1.

Referring to FIG. 2, it can be seen that the rocker arm 22 of this invention is carried in a "U" shaped frame 20 having, in addition to the rocker arm, an opposing arm 24, a back frame member 26, and a brake mounting piece 28. The rocker arm 22 is longer than the opposing arm 24, and it may be seen that an extending segment 30 of the rocker arm 22 extends the rocker arm beyond the axle 18 of the wheel 14 of a skate.

The frame 20 is set behind the skate. In this embodiment, the frame is oriented so that it may wrap around the back of the skate. The frame 20 is pivotally attached to the axle 18 of a wheel 14 of a skate, and held in place by the axle nuts 16. A swiveling cable anchor nut 36 is affixed to the end of the extending segment 30 of rocker arm 22.

The brake mounting piece 28 of the frame 20 has four holes 32 which serve to retain the brake pad (not shown in FIG. 2). A nut 33 is shown above a hole 34, and serves to affix the brake pad (not shown).

Figure 3:
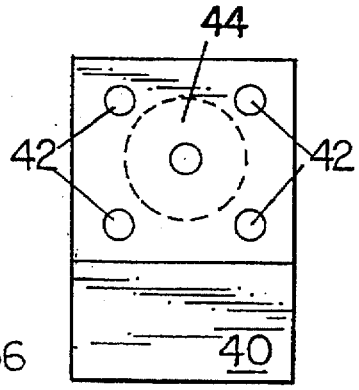
FIG. 3 is a top plan view of a brake pad used in the rocker arm embodiment of FIG. 1.
Figure 4:
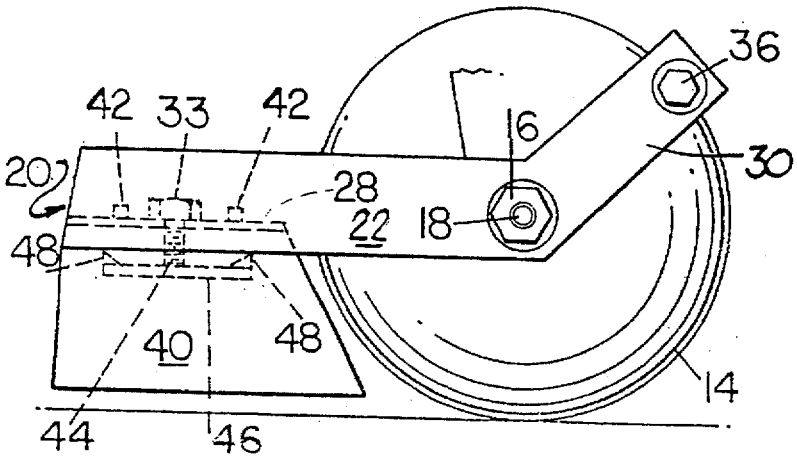
FIG. 4 is a side elevational view of the rocker arm embodiment of FIG. 1, showing the brake pad mounted therein.

With reference both to FIGS. 3 and 4, it can be seen that the brake pad 40 has four nipples 42 protruding from its top surface, and has an embedded bolt 44. Looking at FIG. 4, it can be understood that the brake pad 40 fits securely into the frame 20 within the cup formed at the base of the "U". It can be seen that the embedded bolt 44 of the brake pad 40 passes through the hole 34 (not separately numbered in FIG. 4) of the brake mounting piece 28 and is attached to the mounting piece 28 by bolt 33. The nipples 42 of the brake pad 40 pass through the holes 32 (not separately numbered in FIG. 4) of the brake mounting piece 28 and further secure the brake pad 40 in place.

In FIG. 4, it may also be seen that the embedded bolt 44 of the brake pad has a head 46 having flanges 48. The flanges 48 serve to secure the bolt 44 within the brake pad 40.

Figure 5:
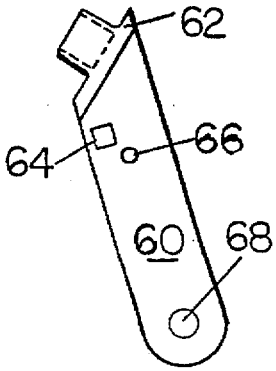
FIG. 5 is a side elevational view of the actuator support arm of the rocker arm embodiment of FIG. 1.

Referring to FIG. 5, the actuator support arm 60 has an actuator housing 62, an arresting arm 64, a first hole 66 and a second hole 68. The actuator housing 62 of the support arm 60 is designed to carry the actuator (not shown) that will activate a rocker arm of the brake carriage 20. In this embodiment, the actuator housing 62 is set for carrying a cable linkage.

The arresting arm 64 of the actuator support arm 60 is designed to be an emergency brake, for use if the actuator should fail. The arresting arm 64 protrudes outward from the actuator support arm 60. The first hole 66 and second hole 68 are designed for attaching the actuator support arm 60 to the skate. In this embodiment, the actuator support arm 60 is slipped over the axle of the skate (not shown in FIG. 5) at the second hole 68, and a self-tapping screw (not shown) is driven through the first hole 66 and into the skate to hold the actuator support arm 60 in place.

Returning to FIG. 1, it can now be seen that the frame 20 is pivotably attached behind the heel of an inline skate boot 10. A typical inline skate, as shown in FIG. 1, includes a skate boot 10 having a wheel housing 12 in which several wheels 14 are mounted. Each wheel 14 is affixed by a nut 16 to an axle 18. The brake frame 20 pivots about the axle 18 of the rearmost wheel 14.

The frame 20 carries the brake pad 40, and the brake frame 20 is slipped onto the axle 18 of the wheel 14 over the actuator support arm 60. The frame 20 is operatively connected to the actuator assembly 80. In this embodiment, the actuator assembly includes a cable 82 having a linkage carried in the actuator housing 62 of the actuator support arm 60.

The rocker arm 22 is connected to cable 82 of the actuator assembly 80. The connection to cable 82 is by way of a swiveling cable anchor nut 36. It should be noted that rocker arm 22 includes extending segment 30 in which the swiveling cable anchor nut 36 is mounted. Segment 30 is angled upwards from the horizontal so as to approach the cable housing stop 62 of the actuator support arm 60, making the cable pull on the rocker arm 22 more efficient.

It can be understood that, when the actuator assembly 80 is engaged so as to pull the cable 82 towards the cable housing stop 62, the resultant force will pull segment 30 of rocker arm 22 towards the cable housing stop 62 of the actuator support arm 60. This, in turn, will cause the brake frame assembly 20 to rotate in a counter-clockwise direction about the pivot axle 18 of the rearmost wheel 14. This rotation will urge the brake pad 40 towards the ground where it will engage the skating surface to stop the skate.

A spring 84 is disposed between the cable anchor nut 36 held in segment 30 of rocker arm 22, and the cable housing stop 62 of the actuator support arm 60. Thus, when the cable 82 is not engaged, the spring tension will push segment 30 of rocker arm 22 away from the cable housing stop 62 of the actuator support arm 60. This, in turn, will cause the brake frame assembly 20 to rotate in a clockwise direction about the pivot axle 18 of the rearmost wheel 14. This rotation will urge the brake pad 40 away from the ground where it will ride until activated by the actuator assembly 80.

The arresting arm 64 of the actuator support arm 60 can now be understood to operate as an emergency brake. In the event that some component of the actuator assembly 80 should fail, the system of this invention uses the arresting arm 64 to simulate the working of a traditional toe-raised brake. It can be seen that the arresting arm 64 extends outward from the actuator support arm 60.

In an emergency situation, the skater may lift the toe of the skate, bringing the brake pad 40 into contact with the ground. This maneuver is performed by the skater pivoting rearwardly about the axis of the rear skate wheel and swinging the skate from the normal coasting position to a braking position where the brake pad 40 drags against the ground. Although the rocker arm 22 of the brake frame 20 will pivot, the arresting arm 64 will limit the arcuate range of rotation, and will lock the rocker arm in place at the limit of rotation. Locked into place, the rocker arm 22 holds the brake pad 40 against the skating surface so that the brake pad will drag against the ground and bring the skater to a stop.

Materials and dimensions suitable for producing this embodiment of the brake system of this invention include these:

The brake frame 20, as shown in FIG. 2, may be of cast steel, aluminum or a high density polymer; the back frame member 26 is about 2.0 inches in length; the rocker arm 22 is about 5.0 inches in length (with the extending segment 30 being about 2.0 inches in length); and the opposing arm 24 is about 3.0 inches in length. The angle formed by the extending segment 30 relative to horizontal is in the range of 15° to 45°.

The brake pad 40 may be molded polyurethane and dimensioned so that the bottom surface is about 1.5 inches by about 2.25 inches so as to provide a stopping surface of about 3.375 square inches. The embedded bolt 44 may be 0.25 inch-20 having 1.0 inch length with a 31/32 inch bolt head.

The actuator assembly 80 may include a cable housing having an outer diameter of about 5.0 mm, and an inner diameter of about 2.0 mm. The cable housing may be of coiled steel with vinyl covering and a TEFLON brand liner. The cable 82 has a diameter of slightly less than 2.0 mm and maybe made of wound steel.

Alternate Rocker Arms

Other forms of a rocker arm are shown in FIGS. 16A–16E. For ease of reference, each rocker arm, and the common elements of the various versions will be designated with identical numerals.

In FIG. 16A, the rocker arm 22 holds brake pad 40 at one end of the rocker arm. The other end of the rocker arm is circular in shape, having a pivot point 23 and a pull point 25. A cable 82 is attached to pull point 25. When the cable is connected to an actuator assembly, a pull on cable 82 will cause rocker arm 22 to rotate about the pivot point, driving the brake pad 40 to the ground. It will be seen that the circular shape of the rocker arm at the end where pull point 25 is located can act as a cam so as to give a mechanical advantage to the mechanism if the cable 82 is set so as to pull across the circumference of the circle.

The rocker arm of FIG. 16A is an integrally formed piece. It is possible, and in some circumstances it may be preferable, to use two pieces to form a rocker arm. In FIGS. 16B and 16C, the rocker arm 22 is in two pieces. In both FIG. 16B and 16C, rocker arm 22 has a first end 27 and a second end 29.

In the rocker arm of FIG. 16B, the first end 27 locks into second end 29 by way of reciprocally shaped groves in the two pieces.

In the rocker arm of FIG. 16C, the first end 27 and the second end are both locked to a shaped axle segment (as illustrated, there is a square-shaped axle segment at pivot point 23, and each of the first end and second end have a square shaped Opening to lock on the axle segment).

Once the two pieces of the rocker arm are locked in place, the structures of FIGS. 16B and 16C function just as the structure of FIG. 16A, it being understood that both of these structures have a pivot point 23 and a pull point 25 in the circular second end 29 of the rocker arm 22. A cable 82 attached to the pull point 25 can rotate the rocker arm about the pivot point, driving the brake pad 40 to the ground.

FIG. 16D illustrates a rocker arm that is divorced from any frame (frame 20, for example, in FIG. 1). It should already be clear from an understanding of the basic rocker arm that the frame is not necessary, rather it is simply necessary to have a rocker arm carrying a brake about a pivot point. Particularly for expert skaters, who do not want the encumbrance of a brake frame carried behind the skate, a more compact rocker arm is a preferred approach.

With reference to FIG. 16D, it may be understood that a rocker arm embodiment of this invention may be a simple rocker arm 22 having a pivot point 23, a pull point 25, and carrying a brake pad 40. A cable 82 is attached to pull point 25. When the cable is connected to an actuator assembly, a pull on cable 82 will cause rocker arm 22 to rotate about the pivot point, driving the brake pad 40 to the ground. It will be seen that the circular shape of the rocker arm at the end where pull point 25 is located can act as a cam so as to give a mechanical advantage to the mechanism if the cable 82 is set so as to pull across the circumference of the circle.

The rocker arm 22 of FIG. 16D has a shaped opening at the pivot point 23 so that the rocker arm may be locked to an axle having a reciprocally shaped segment. As illustrated in FIG. 16D, the shaped opening is hexagonal.

FIG. 16E illustrates a simple rocker arm 22 much like the rocker arm of FIG. 16D.

The rocker arm of FIG. 16E has a pivot point 23, a pull point 25, and carrying a brake pad 40. A cable 82 is attached to pull point 25. When the cable is connected to an actuator assembly, a pull on cable 82 will cause rocker arm 22 to rotate about the pivot point, driving the brake pad 40 to the ground. It will be seen that the circular shape of the rocker arm at the end where pull point 25 is located can act as a cam so as to give a mechanical advantage to the mechanism if the cable 82 is set so as to pull across the circumference of the circle.

The rocker arm 22 of FIG. 16E has an axle 31 integrally formed therein, or fixedly connected thereto. It does not need to lock into the axle as was the case with the embodiment of FIG. 16D.

The rocker arms 22 of FIGS. 16D and 16E offer some significant advantages to the more advanced skater, and may be desirable for all skating levels. These are relatively small units, and they may be mounted (with appropriate spacers, well known in the art) directly on the wheel axle of a skate. They may also be mounted to the frame on an axle parallel to the wheel axles, but apart from the wheels.

Further, these rocker arms may be mounted in sets (with yoked cable pulls, well known in the art) so that a single skate might have rocker arms in tandem at one, two, three or more wheels. As illustrated, these rocker arms carry a brake pad 40 which is wider than the rocker arms 22, primarily to permit a relatively large area on the brake surface which contacts the ground. But, when two, three or more rocker arms are used in tandem on the skate, each one can carry a thinner brake pad 40 and still provide adequate brake surface in contact with the ground.

It is possible, therefore, to design a very thin, small, and unobtrusive brake system using these rocker arms. Such a small brake system would not interfere significantly with the maneuvering of an expert skater (that is, there would be little or nothing that might drag on the ground in extreme canting or other extreme positioning of the skate), but would still provide the benefits of this invention to such a skater.

The rocker arms of FIG. 16D and 16E both carry separate brake pads 40. It should be understood that the brake surface may simply be an end of the rocker arm itself.

Such a surface may be on an elongated end of a rocker arm of the type shown in FIGS. 16A–16C (this is one reason why the two-piece rocker arm structures of 16B and 16C may be particularly advantageous—in those embodiments, the end 27 of the rocker arm which would be driven to the ground and would therefore act as the braking surface, can be formed of a material separate from the material of the other end 29, and can be replaced separately from the other end 29).

Such a surface may also be an elliptical "bulge" on a generally circular-shaped rocker arm of the type shown in FIGS. 16D and 16E. Such an elliptical bulge is described in some detail later in this disclosure with reference to the "integrated" delivery mechanisms (reference FIGS. 21, 22 and 29), and that explanation is equally suitable to describe an elliptical bulge that could be formed directly on the rocker arms of FIGS. 16D and 16E so as to provide a brake surface while eliminating the need for a separate brake pad 40.

Yet another rocker arm delivery arrangement is shown in FIGS. 23 and 24. These embodiments show that the rocker arm need not be disposed behind the rearmost wheel of the skate.

In FIG. 23, a rocker arm 22 has a pivot point 23 and a pull point 25. A brake pad 40 is carried by the rocker arm, and the rocker arm is set on axle 18 of wheel 14B of a skate. Cable 82 is attached to pull point 25 of rocker arm 22, and spring 84 is attached to pull point 25 so that the rocker arm will rotate about pivot point 23 when the cable is pulled so as to drive the brake pad 40 to the ground; spring 84 serves to hold the brake pad above the skating surface when the cable 82 is not pulled (stop 71 within the skate frame 12 prevents the rocker arm from being pulled too far by the spring).

The rocker arm of FIG. 23 is disposed behind wheel 14B, which is not the rearmost wheel of the skate (as illustrated, wheel 14A is the rearmost wheel). An advanced skater may appreciate not having a brake apparatus overhanging the rear of the skate, and may prefer the placement of the brake as shown in FIG. 23.

FIG. 24 is substantially like the rocker arm of FIG. 23. The similarities will not be discussed, but the difference is that pivot point 23 is not limited to placement at the axle 18 of the wheel 14B. Instead, the pivot point is set in frame 12. This provides additional freedom to the brake designer because to permits the axis of the rocker arm to be lower or higher than the axle of the wheel for adjusting the brake force.

The foregoing description of the rocker arm delivery mechanism of this invention is to be understood in light the further description of various refinements and variations to the system of this invention which follows, as well as in light of adaptations readily apparent to those skilled in the art. In particular, and among other variations, it will be understood that the rocker arm may be shaped as an eccentric/round figure, does not require a supporting frame, need not be placed at an axle of the skate, and need not be placed at or near the axle of the rearmost wheel.

Basic Carriage Delivery Mechanism

Figure 6:
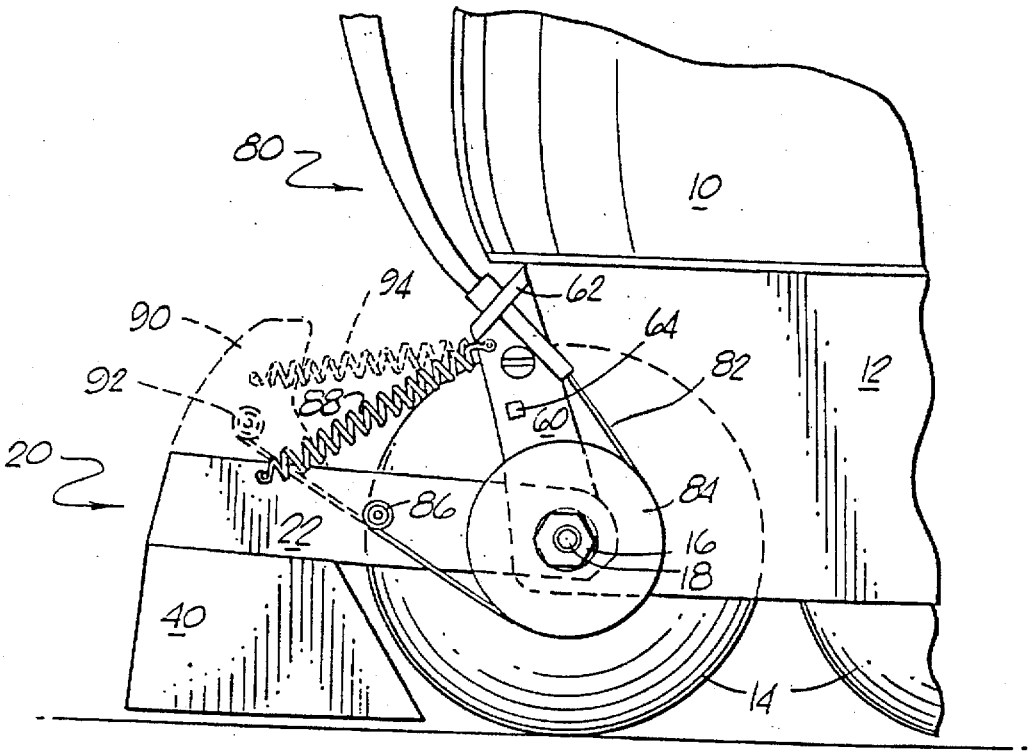
FIG. 6 is a side elevational view of a carriage embodiment of the delivery mechanism of the brake system of this invention.

With reference to FIG. 6, it can be seen in overview that a basic carriage delivery mechanism of the brake system of this invention includes a brake carriage 20, a brake pad 40, an actuator support arm 60, and an actuator assembly 80 (for ease of reference, structures which are common to the carriage delivery mechanism and the rocker arm mechanism already discussed will be designated with identical numerals, but with frame 20 of the rocker arm now being referred to as carriage 20, and with rocker arm 22 now being referred to as a first arm 22). In this embodiment, a pulley 84 serves as the variable force mechanism, and an arm 64 on the actuator support arm 60 serves as the arresting mechanism. Each of these elements will be discussed individually, and with reference to FIGS. 7–9 before returning to FIG. 6 for a discussion of the elements in combination.

Figure 7:
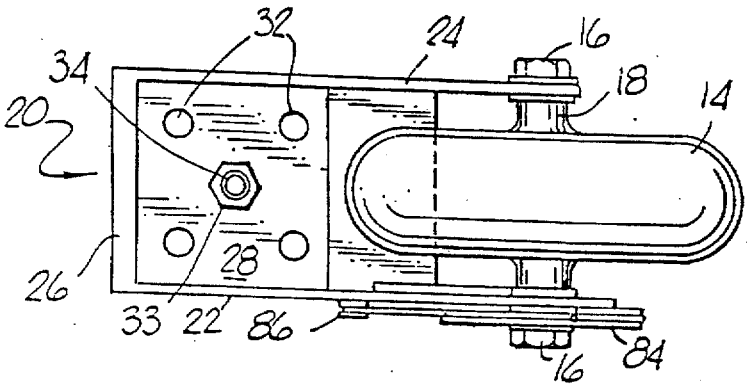
FIG. 7 is a top plan view of the carriage embodiment of FIG. 6.

Referring to FIG. 7, it can be seen that the brake carriage 20 of this invention is a "U" shaped frame having a first arm 22, a second arm 24, a back frame member 26, and a brake mounting piece 28.

It can be seen that the brake carriage 20 is set behind the skate. In this embodiment, the carriage 20 is oriented so that it may wrap around the back of the skate. The brake carriage is pivotally attached to the axle 18 of a wheel 14 of a skate, and held in place by the axle nuts 16. A pulley 84 is mounted on axle 18, and a retaining pin 86 is mounted on carriage arm 22.

The brake mounting piece 28 of the brake carriage 20 has four holes 32 which serve to retain the brake pad (not shown in FIG. 7). A nut 33 is shown above a hole 34, and serves to affix the brake pad (not shown).

Figure 8:
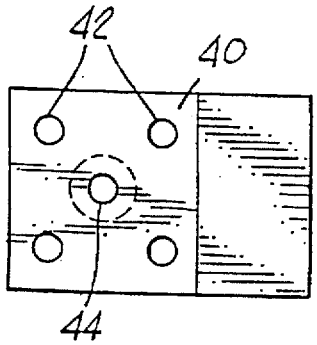
FIG. 8 is a top plan view of a brake pad used in the carriage embodiment of FIG. 6.
Figure 9:
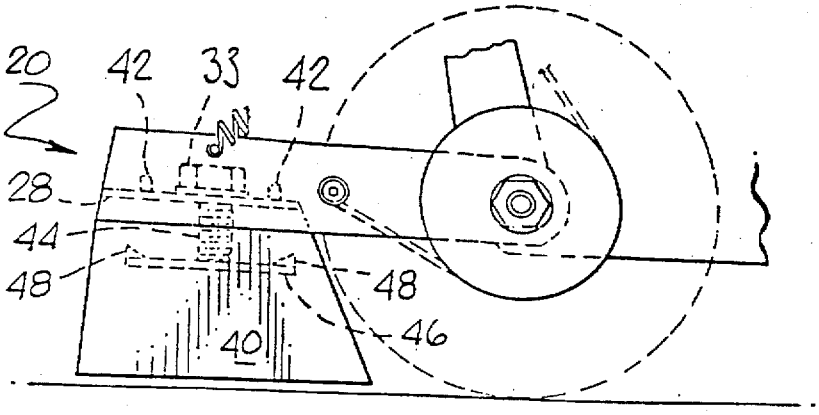
FIG. 9 is a side elevational view of the carriage embodiment of FIG. 6, showing the brake pad mounted therein.

With reference to FIG. 8, it can be seen that the brake pad 40 has four nipples 42 protruding from its top surface, and has an embedded bolt 44. Looking at FIG. 9, it can be understood that the brake pad 40 fits securely into the brake carriage 20 within the cup formed at the base of the "U". It can be seen that the embedded bolt 44 of the brake pad 40 passes through the hole 34 (not separately numbered in FIG. 4) of the brake mounting piece 28 and is attached to the mounting piece 28 by bolt 33. The nipples 42 of the brake pad 40 pass through the holes 32 (not separately numbered in FIG. 9) of the brake mounting piece 28 and further secure the brake pad 40 in place. In FIG. 9, it may also be seen that the embedded bolt 44 of the brake pad has a head 46 having flanges 48. The flanges 48 serve to secure the bolt 44 within the brake pad 40.

Returning to FIG. 6, it can now be seen that the brake carriage 20 is pivotably attached behind the heel of an inline line skate boot 10. A typical inline skate, as shown in FIG. 6, includes a skate boot 10 having a wheel housing 12 in which several wheels 14 are mounted. Each wheel 14 is affixed by a nut 16 to an axle 18. The brake carriage 20 pivots about the axle 18 of the rearmost wheel 14.

The brake carriage 20 carries the brake pad 40, and the brake carriage 20 is slipped onto the axle 18 of the wheel 14 over the actuator support arm 60. The brake carriage 20 is operatively connected to the actuator assembly 80. In this embodiment, the actuator assembly includes a cable 82 having a linkage carried in an actuator housing 62 of the actuator support arm 60, and a pulley 84 mounted on the axle 18.

Arm 22 of the brake carriage 20 is connected to cable 82 of the actuator assembly 80 at retaining pin 86. Retaining pin 86 is located along the arm as shown. Cable 82 runs from the retaining pin, around pulley 84, and to the linkage carried in actuator housing 62.

It can be understood that, when the actuator assembly 80 is engaged so as to pull the cable 82 towards the actuator housing 62, the resultant force will pull the carriage arm 22 towards the periphery of pulley 84. This, in turn, will cause the brake carriage assembly 20 to rotate in a counter-clockwise direction about the pivot axle 18 of the rearmost wheel 14. This rotation will urge the brake pad 40 towards the ground where it will engage the skating surface to stop the skate.

A tension spring 88 is attached, at one end, to arm 22 of the brake carriage and, at the other end, near actuator housing 62 of the actuator support arm 60. Thus, when the cable 82 is not engaged, the spring tension will pull carriage arm 22 towards actuator housing 62. This, in turn, will cause the brake carriage assembly 20 to rotate in a clockwise direction about the pivot axle 18 of the rearmost wheel 14. This rotation will urge the brake pad 40 away from the ground where it will ride until activated by the actuator assembly 80.

It should be readily understood that the responsiveness of the brake system is influenced by the location of retaining point 86 on the arm in relation to pivot axle 18, which is the pivot point about which the arm rotates. If desired, the responsiveness of the brake system may be further influenced by fixing a retaining pin even further away from pivot axle 18. As will be described below, one way to do so is by using a separate mounting assembly to extend the retaining pin beyond arm 22.

Shown in phantom in FIG. 6 is amounting assembly 90 set on top of carriage 20. It can be understood that retaining pin 86 could be removed and that cable 82 could be extended so as to reach the mounting assembly. With reference to the phantomed structure shown in FIG. 6, it may be seen that the cable could be secured to mounting assembly 90 at a retaining pin 92, and a tension spring 94 could be set between the mounting assembly 90 and actuator support arm 60. By adjusting the location of the retaining pin in relation to the axis of rotation 18, including placement of the retaining pin above the brake carriage, the retaining pin is extended beyond arm 22 and the responsiveness of the brake system may be tuned as desired.

The arresting arm 64 of the actuator support arm 60 can now be understood to operate as an emergency brake. In the event that some component of the actuator assembly 80 should fail, the system of this invention uses the arresting arm 64 to simulate the working of a traditional toe-raised brake. It can be seen that the arresting arm 64 extends outward from the actuator support arm 60. In an emergency situation, the skater may lift the toe of the skate, bringing the brake pad 40 into contact with the ground. This maneuver is performed by the skater pivoting rearwardly about the axis of the rear skate wheel and swinging the skate from the normal coasting position to a braking position where the brake pad 40 drags against the ground. Although carriage arm 22 of the brake carriage 20 will pivot, the arresting arm 64 will limit the arcuate range of rotation, and will lock the rocker arm in place at the limit of rotation. Locked into place, the rocker arm 22 holds the brake pad 40 against the skating surface so that the brake pad will drag against the ground and bring the skater to a stop.

Finally, although the brake system as shown discloses an actuator assembly that includes a pulley 84 to obtain a mechanical advantage, it should be understood that the brake system of this invention may be operated with any number of well known equivalent structures, all serving to transmit force to carriage 20 so as to rotate the carriage about a pivot axis.

Materials and dimensions suitable for producing this embodiment of the brake system of this invention include these:

The brake carriage 20 as shown in. FIG. 7, may be of cast steel, aluminum, or a high density polymer; the back frame member 26 is about 2.0 inches in length; carriage arms 22 and 24 are about 3.0 inches in length.

The brake pad 40 may be molded polyurethane, and dimensioned so that the bottom surface is about 1.5 inches by about 2.25 inches so as to provide a stopping surface of about 3.375 square inches. The embedded bolt 44 may be 0.25 inch-20 having 1.0 inch length with a 31/32 inch bolt head.

The actuator assembly 80 may include a cable housing having an outer diameter of about 5.0 mm, and an inner diameter of about 2.0 mm. The cable housing may be of coiled steel with vinyl covering and a TEFLON brand liner. The cable 82 has a diameter of slightly less than 2.0 mm and may be made of wound steel.

An Alternate Carriage Delivery Mechanism

Another embodiment of the basic carriage delivery mechanism just discussed in connection with FIGS. 6–9 is shown in FIGS. 14 and 15. This alternate embodiment is similar in general operation to the basic embodiment, but it incorporates a variable force mechanism having a lever arm and cam arrangement. In the discussion that follows, it will be assumed that the first embodiment (FIGS. 6–9) of the carriage is well understood, and only the differences present in the alternate embodiment of FIGS. 14 and 15 will now be emphasized.

With reference to FIG. 15, it can be seen that a lever arm 180 is connected to the back of brake carriage 20 so that the arm is angled generally upward from the back of the brake carriage and is pointed towards the front of the skate. A support collar 182 helps to support the lever arm 180. A cam 184 has a pull point 186, a leverage point 188, and a connecting point 190. A brake pad 40 is mounted in the carriage 20 and the carriage is pivotally connected to a skate (not shown) at the axle of the rearmost wheel 14.

Connecting point 190 of the cam 184 is connected to the lever arm 180 at a point near the end of the lever arm furthest removed from the back of the carriage 20. A cable 82 is attached to pull point 186 of the cam. When the cable is engaged, the lever arm 180 will rotate the carriage 20 about the axle of the wheel, driving the brake pad down to the ground. A spring, not shown, may provide the counter-force for holding the carriage above the skating surface when the brake is not engaged.

The leverage point 188 of cam 184 is used to adapt the lever arm 180 and cam to variously shaped skates. A rod (not shown) may be passed through leverage point 188 to hold the cam against the lever arm at a predetermined angle. By altering the location of leverage point 188 within the cam 184, the geometry of the cam action will be changed. The introduction of the leverage point 188 permits a variable fitting of the carriage 20 to differently shaped skates with only a change-over of the cam 184, rather than a complete redesign and change-over of the carriage 20 and lever arm 180. Because a change of the location of leverage point 188 in cam 184 should be appreciably easier and more cost-effective than a change of the carriage and lever arm, this feature makes the carriage more readily available to a wide range of skates at a relatively modest design and development cost.

FIG. 14 shows a side view of the carriage of FIG. 15, in which it may be seen that the brake pad 40 may be securely attached to carriage 20 by bolt 192 within the carriage. In FIG. 14, it may be seen that a housing 194 may cover the carriage assembly.

The foregoing description of the carriage delivery mechanism of this invention is to be understood in light of the further description of various refinements and variations to the system of this invention which follows, as well as in light of adaptations readily apparent to those skilled in the art. In particular, and among other variations, it will be understood that the carriage does not require a separate back connecting member, does not require anything other than a Single "U" shaped piece, need not be placed at an axle of the skate, and need not be placed at the axle of the rearmost wheel.

Basic Plunger Delivery Mechanism

Figure 10:
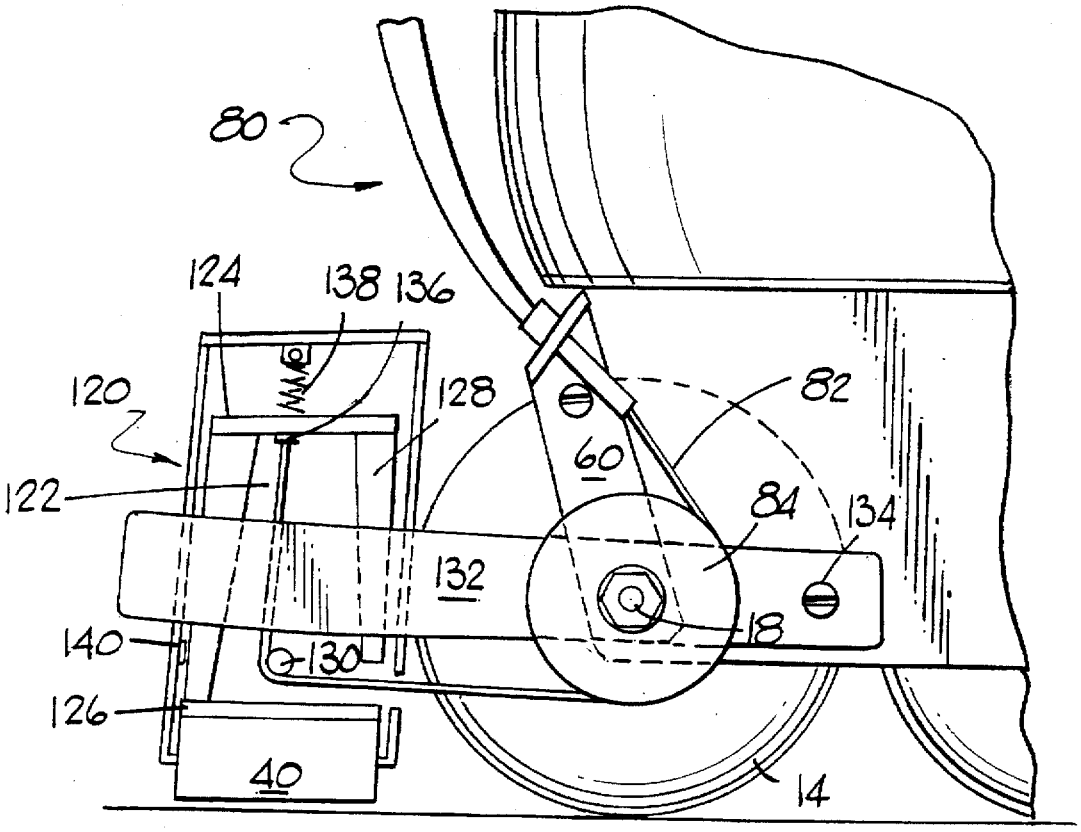
FIG. 10 is a side elevational, partially cut away view of a plunger embodiment of the delivery mechanism of the brake system of this invention.

With reference to FIG. 10, it can be seen in overview that a basic plunger delivery mechanism of the brake system of this invention includes a plunger housing 120, a brake pad 40, an actuator support arm 60, and an actuator assembly 80 (for ease of reference, structures which are common to the plunger delivery mechanism and the delivery mechanisms already discussed will be designated with identical numerals). Moreover, many of the workings of the plunger delivery mechanism are the same as the other delivery mechanisms and will not be repeated here in detail. In this embodiment, pulleys 84 and 130 serve as the variable force mechanism, and a bead 140 within the plunger housing 120 serves as the arresting mechanism.

The plunger housing 120 houses a plunger 122 having a top surface 124 and a bottom surface 126 joined together by a plunger wall 128. In a preferred embodiment, plunger 122 is channeled and hollowed in order to accommodate cable 82 and pulley 130 in the interior of the plunger, but it should be understood that the plunger may be constructed many other ways, including by fabricating an open frame that joins the top and bottom surfaces.

The plunger housing is mounted to the rear of the skate and is oriented so that the plunger axis is generally vertical relative to the skating surface. In this embodiment, the housing 120 is mounted to a support 132 which wraps around the rear of the skate. Support 132 is secured to the skate at the axle 18 of the rearmost wheel 14, and is further secured by bolt 134.

The brake pad 40 is fixed to the bottom surface 126 of plunger 122. The bottom surface 126 works as does the brake mounting plate 28 already discussed with reference to the other delivery mechanisms. Bottom surface 126 and brake pad 40 may include the bolt, nipples, holes and other structures previously discussed, with such adaptations as would be easily understood by one skilled in the art to secure the attachment of brake pad to bottom surface of the plunger.

The plunger housing 120 is operatively connected to the actuator assembly 80. In this embodiment, the actuator assembly includes a cable 82 having a linkage carried in an actuator housing 62 of the actuator support arm 60, and a pulley 84 mounted on the axle 18.

Plunger 122 is connected to cable 82 of the actuator assembly 80 at retaining pin 136. Cable 82 runs from the retaining pin, around pulleys 130 and 84, and to the linkage carried in actuator housing 62.

It can be understood that, when the actuator assembly 80 is engaged so as to pull the cable 82 towards the actuator housing 62, the resultant force will pull the plunger 122 downwards towards the skating surface. This movement will urge the brake pad 40 towards the ground where it will engage the skating surface to stop the skate.

A tension spring 138 is attached, at one end, to the top surface 124 of the plunger and, at the other end, to the plunger housing 120 near the top of the housing. Thus, when the cable 82 is not engaged, the spring tension will pull the plunger upwards. This tension will urge the brake pad 40 away from the ground where it will ride until activated by the actuator assembly 80.

An arresting bead 140 within the plunger housing 120 can now be understood to operate as an emergency brake. In the event that some component of the actuator assembly 80 should fail, the system of this invention uses the arresting bead 140 to simulate the working of a traditional toe-raised brake. It can be seen that the arresting bead 140 extends inward ward from the interior wall of the housing 120.

In an emergency situation, the skater may lift the toe of the skate, bringing the brake pad 40 into contact with the ground. This maneuver is performed by the skater pivoting rearwardly about the axis of the rear skate wheel and swinging the skate from the normal coasting position to a braking position where the brake pad 40 drags against the ground. Although plunger 122 will be pushed upwards, the arresting bead 140 will contact the outer lip of the bottom surface 126 of the plunger so as to limit the range of movement, and will lock the plunger in place at the limit of movement. Locked into place, the housing 120 holds the brake pad 40 against the skating surface so that the brake pad will drag against the ground and bring the skater to a stop.

The plunger housing and plunger assembly just described use a direct pull to bring the plunger down towards the skating surface. It should be readily understood that other, equivalent mechanisms may also be used, including mechanisms using worm gears, levers and like devices to gain a further mechanical advantage.

For example, a worm gear of the type shown in FIG. 17A, or a take-up spool of the type shown in FIG. 17B could replace the pulleys just discussed. With reference to FIG. 17A, and with the worm gear 45 shown therein mounted inside the plunger housing, a cable 82 attached to pull point 25 and a spring-loaded counter-force (not shown) could drive the brake pad 40 to the ground when the brake is engaged and hold it above the ground when not engaged. So also, the take-up spool 47 of FIG. 17B, mounted inside the plunger housing, with a cable 82 attached to the spool 47 and with a counter-force, could drive the brake pad 40 to the ground when the brake is engaged and hold it above the ground when not engaged.

Basic Side Rail Delivery Mechanism

Figure 11:
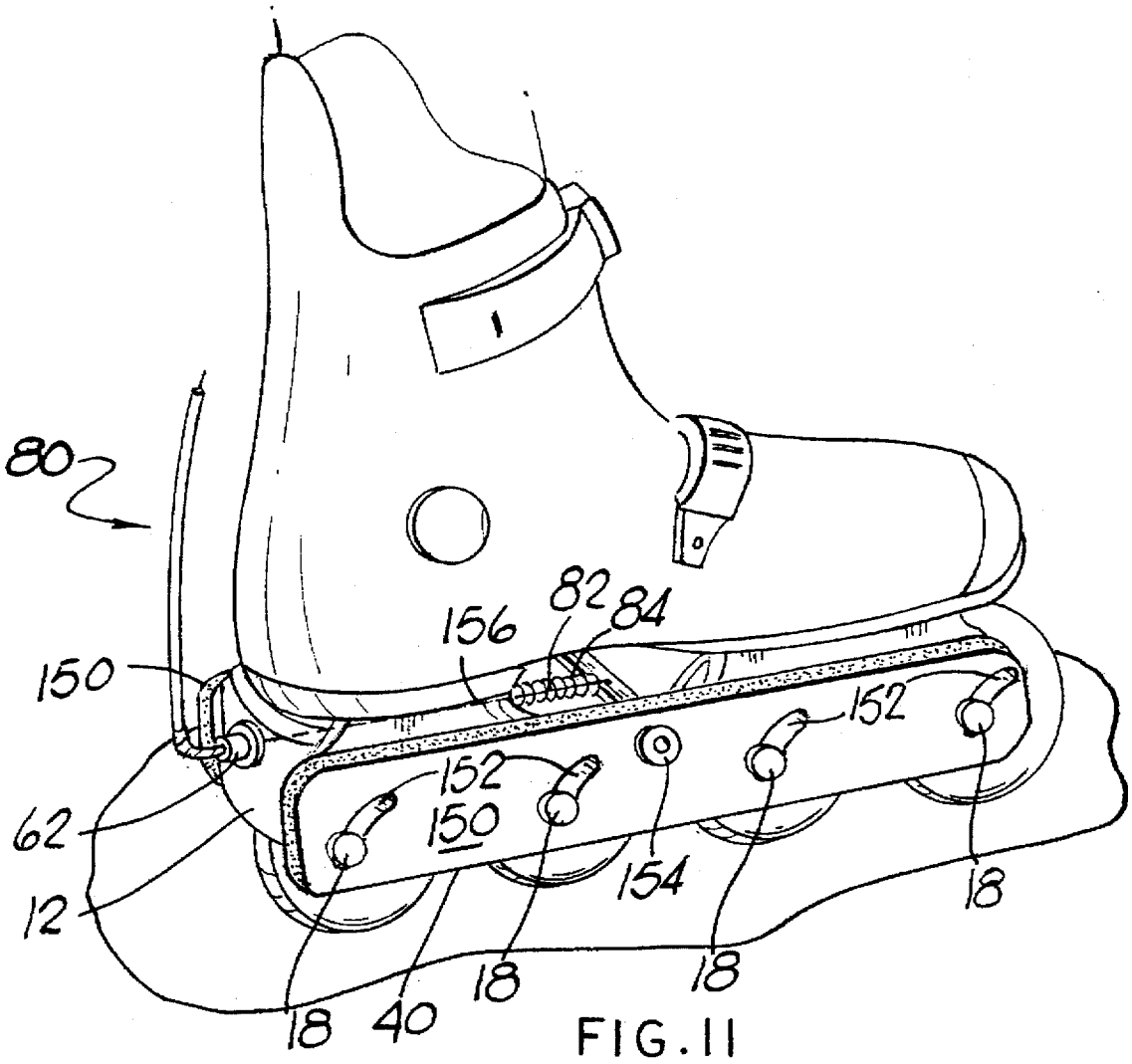
FIG. 11 is a perspective view of a side rail embodiment of the delivery mechanism of the brake system of this invention.

With reference to FIG. 11, it can be seen in overview that a basic side rail delivery mechanism of the brake system of this invention includes a pair of side rails 150 and brake pads 40, an actuator housing 62, and an actuator assembly 80 (for ease of reference, structures which are common to the side rail delivery mechanism and the delivery mechanisms already discussed will be designated with identical numerals).

Each side rail 150 is attached to the frame 12 of a skate by way of four cut-outs 152. The cut-outs are disposed so as to fit over the axles 18 of the wheels of the skate, and are shaped as elongated groves describing a path along which the side rails may move. The two side rails are connected to one another by a rod 154. Cable 82 of the actuator assembly 80 runs from rod 154 through actuator housing 62.

Figure 12:
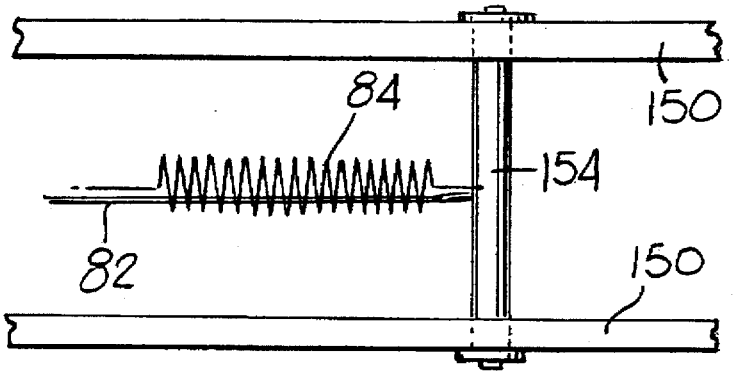
FIG. 12 is a top plan view of certain details of FIG. 11.

When the actuator assembly 80 is engaged so as to pull cable 82 towards the actuator housing 62, the resultant force will pull rod 154 towards the rear of the skate, forcing the two side rails down in the path described by the cut-outs 152. As can be seen with reference to FIG. 11, the elongated groove of each of the cut-outs describes an arc so that the side rails are urged towards the ground when the actuator is engaged. This movement drives the brake pads 40 to the ground. A compression spring 84 is attached, at one end, to rod 154 and, at the other end, to a stop bar 156. Thus, when the cable 82 is not engaged, the spring force will push rod 154 towards the front of the skate, urging the brake pads 40 away from the ground where they will ride until activated by the actuator assembly 80. With reference to FIG. 12, rod 154, cable 82, and spring 84 may be seen between the two side rails 150 (with certain other details of FIG. 11 omitted).

An Alternate Side Rail Delivery Mechanism

Figure 13:
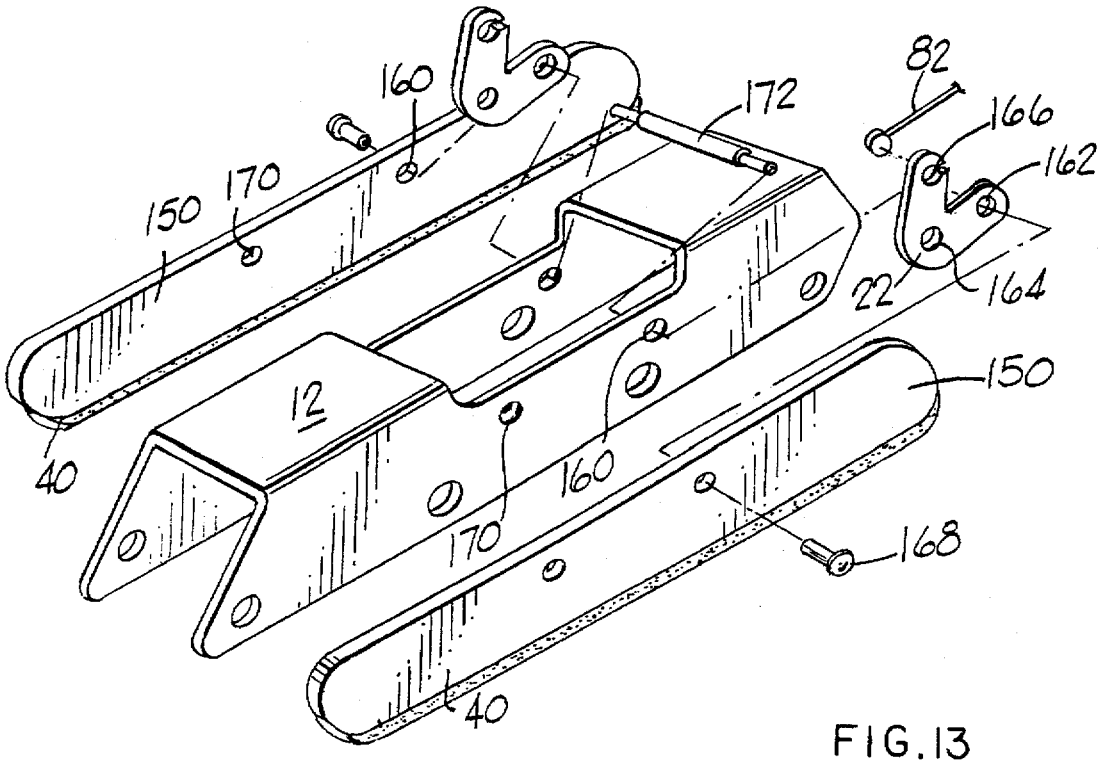

The side rail delivery mechanism just discussed makes use of the axles of the wheels and associated cut-outs 152 to drive the side rails 150 towards the ground. With reference to FIG. 13, an alternative arrangement may be seen. A standard skate frame 12 can be adapted to work with two side rails 150 by drilling a first pair of holes 160 and a second pair of holes 170 from one side of the frame to the other.

A rocker arm 22 has a pivot point 162, a tie rod point 164, and a pull point 166. A rivet 168 passes through the side bar 150, pivot point 162 of rocker arm 22, and hole 160 of the frame 12. An identical arrangement of a rocker arm (shown but not separately numbered in FIG. 13) on the opposite side of the frame connects the other side rail 150 to the frame. A tie bar 172 joins the tie rod points 164 of the two rocker arms 22 together.

An identical pair of rocker arms (not shown in FIG. 13) is attached between the side rails 150 and the frame 12 at points 170. It should be understood that there are a total of four rocker arms 22, one pair at points 160 and the other pair at points 170 of the frame. Thus, each of the side rails 150 is pivotally held in place by two rocker arms, one rocker arm at point 160, and another rocker arm at point 170.

Cable 82 is attached to pull point 166 of a rocker arm 22. When the cable is engaged, the side rail 150 will swing about the rocker arm pivot point 162 and will be urged towards the ground. As a result, brake surface 40 will be driven against the ground for stopping the skate. A counterforce may be provided by a spring (not separately shown, but readily understood by persons skilled in the art) for holding the side rails above the skating surface when the brake is not engaged.

Basic Integrated Delivery Mechanism

With reference to FIG. 21, it can be seen in overview that a basic integrated delivery mechanism of the brake system of this invention includes: a rocker arm 22, a brake pad 40, and an actuator assembly 80 (for ease of reference, structures which are common to the integrated delivery mechanism and the delivery mechanisms already discussed will be designated with identical numerals). Each of these elements will be discussed individually, and with reference to FIG. 22 before returning to FIG. 21 for a discussion of the elements in combination.

Referring to FIG. 22, it can be seen that this integrated delivery mechanism is specially adopted to be fitted into an existing skate frame 12 which has a built-in brake housing 13 designed to accommodate a conventional toe-raised fixed brake. That is, in such an existing housing, a brake pad would be fixedly mounted within housing 13, and the skater would stop the skate by raising the toe of the skate so as to pivot the skate about the axle of the rear wheel, thereby driving the housing 13 (which would carry the fixed brake) to the ground.

Because housing 13 is integrally formed within the frame 12 of an existing skate, the delivery mechanisms of this invention previously discussed would be impossible, or at least very awkward, to mount behind the rearmost wheel of such a skate. The integrated delivery mechanism of this invention makes use of the existing housing 13, and allows the advantages of this invention to be realized even in such a skate. In the discussion which follows, it must be understood that the preexisting brake pad which would have been mounted within housing 13 has been removed and discarded, leaving the housing 13 open for receiving the device of this invention.

For this integrated delivery mechanism, a specially shaped brake pad 40 is used. Brake pad 40 is of a compound shape, in cross section being roughly circular, but having an eccentric radius to create an elliptical aspect. Further, the cross section may display a cut-out from the center towards the surface so as to further inscribe a "C" shape to the brake pad 40. The purpose of this cut-out will be explained later.

Rocker arm 22 is joined to brake pad 40 by a shaped axle 200 that passes through a reciprocally shaped opening 202 in the brake pad. As shown, the shaped axle and reciprocal opening are hexagonal. The shaped axle 200 is passed through the opening 202 of the brake pad, thereby effectively locking the brake pad 40 to the axle 200. As can be seen, axle 200 is carried within housing 13 at pivot points 206. With the locked axle/brake pad unit set inside housing 13, the rocker arm 22 may be slid onto an end of the axle 200 at rocker arm pivot point 204. Pivot point 204 has a shaped connecting end 207 (hexagonally shaped in this example) for locking the rocker arm to the axle.

Other components in the integrated unit of this invention include a spring 208; a cable 82 having an end affixed to the rocker arm 22 at point 210; a cover 212 having a cut-out 214 to accommodate the cable 82; and lock nuts and washers 216 and 218 to hold the axle 200 in place.

Referring now to FIGS. 21 and 22 in combination, it should be understood that, when the actuator assembly 80 is engaged so as to pull the cable 82, the resulting force will pull the rocker arm at point 210. This will rotate the shaped axle 200 and carry the brake pad 40 in rotation with the axle 200. The eccentricity of the radii (for example, radii 220 and 222 with reference to FIG. 21) of the brake pad is predetermined so that the elliptical "bulge" of the pad will be driven to the ground with the rotation of axle 200 where it will engage the skating surface to stop the skate. This effect may be enhanced by setting the axle 200 off-center through the brake pad 40, as shown (it being noted that shaped opening 202 is placed closer to the circumference than to the center of the brake pad). The spring 208 provides a counterforce so that the brake will ride above the ground when not engaged.

The size and shape of the brake within the housing 13 create an arresting mechanism that may operate as an emergency brake. In the event that some component of the actuator assembly 80 should fail, the skater may lift the toe of the skate, bringing the brake pad 40 into contact with the ground. Although the brake pad may rotate about the axle 200 to some extent, a limit will be reached at which point the elliptical bulge of the brake will lock against the inside of the housing 13. Locked into place, the brake pad 40 will hit the skating surface as the skater raises the toe of the skate so that the brake pad will drag against the ground and bring the skater to a stop.

It was previously mentioned that the brake pad 40 may have a cut-out from the center towards the surface so as to further inscribe a "C" shape to the brake pad 40. The reason for this is that many of the existing fixed housings such as housing 13 have a support bar running across the opening into which the brake pad 40 is to be placed. The cut-out is designed to fit around any such support bar. It may be appreciated that the brake pad 40 must be designed with regard the housing 13 into which it will be placed, and will be of a width so as to fit snugly into the housing. Although the details of the shape and fit will depend upon the housing, and cannot be given in the abstract, any person skilled in the art will be able to determine the appropriate shape and fit once a particular housing is selected.

An Alternate Integrated Delivery Mechanism

Another embodiment of the basic integrated delivery mechanism just discussed in connection with FIGS. 21 and 22 is shown in FIGS. 29–30. This alternate embodiment is similar in general operation to the basic embodiment, but it begins from a different premise and a different starting point.

The premise of the basic integrated unit is that the choice of brake systems was constrained by the fact of a pre-existing housing (reference 13 in FIG. 22) that is not easily removable. Making the best of the situation, the basic integrated delivery mechanism turns the existing housing 13 to good advantage, and builds a ground engaging movable brake into the fixed housing 13.

The premise of this alternate integrated unit is that some skaters may prefer, and some skates may be better suited for, an integrated type of delivery mechanism rather than one of the other delivery mechanisms already discussed. The starting point, therefore, is a brake frame that does not have a preexisting fixed housing, but to which something like the delivery mechanism of FIGS. 21 and 22 is nevertheless desired to be affixed.

With reference to FIG. 29, it may be seen that the rear frame 12 of an existing skate may contain a grooved channel 73. A housing 15, a cam 17, and a support arm 19 provide the basis for creating an integrated delivery mechanism for use with frame 12.

Cam 17 is inserted into slot 31 of the housing 15, and this unit is fixed to the skate at an axle (which could be the axle of the rearmost wheel, or could be another axle near the back of the skate), with the axle passing through hole 33 of the cam. Support arm 19 is connected at one end thereof to housing 15 by any convenient means, such as a bolt. The support arm 19 carries, at its other end, a set of adapting pegs 35 which lock into grooved channel 73 of the frame 12. Thus, attached to the skate at an axle through the cam 17 of the housing 15, and at the back of the frame 12 by the support arm 19, the housing is rigidly fixed behind the skate.

Into the housing 15, a ground engaging movable brake may be set, precisely as in the basic embodiment just discussed with reference to FIG. 22. Looking at FIG. 29, it can be seen that this embodiment contains the same components as the basic integrated delivery mechanism, including the elliptically shaped brake pad 40; rocker arm 22; shaped axle 200; reciprocally shaped opening 202 in the brake pad 40 for locking on to the axle; pivot point 204 of the rocker arm with shaped connecting end 207 for locking on to the axle 200; spring 208; cable 82 having an end affixed to the rocker arm 22 at pull point 210; a cover 212 having a cut-out 214 to accommodate the cable 82; and lock nuts and washers 216 and 218 to hold the axle 200 in place.

With these components set into the housing 15, and with the housing fixed to the skate, this alternate embodiment works just like the basic integrated delivery mechanism already described with reference to FIGS. 21 and 22, and that description will not be repeated here.

FIG. 30 is a side view of the housing 15 of the embodiment of FIG. 29, showing the support arm 19 connected to the housing by an embedded bolt 37. It should be understood that cam 17 is not essential (because the axle could simply run through a hole in the housing 15 for connection to the skate), but is provided as a feature for ease of use. As shown in phantom in FIG. 30, the location of hole 33 of the cam 17 may be alternated, and the alternate locations are designated 33A and 33B.

The advantage of this is that skate frames and wheels come in multiple sizes. In order to dispose the housing 15 so that it rides at the proper distance above the skating surface, one could either produce a large number of housings, each appropriate for a particular skate; or one could produce one or only a few housings, adapting the housing to a particular skate by way of the cam. It should be appreciated that it will be easier and more efficient to produce only one or a few housings with a number of adjustable cams, rather than to produce a large number of custom fitted housings.

Thus, with reference to FIG. 30, it can be understood that, with the axle running though hole 33A of cam 17, the housing 15 will ride relatively further away from the skating surface than it would with the axle running through hole 33B. This effect can be achieved by using a single cam with both holes 33A and 33B. The effect can also be achieved by using different cams for different skate geometries. FIG. 31 shows another cam 17 with hole 33 disposed nearly in the center provide yet another adjustment to the position of the housing.

Finally, it should be noted that the grooved channel 73 of frame 12 shown in FIG. 29 is based on one existing inline skate model. Other models lack such a channel, but have holes near the back of the frame. On yet other models, there are no holes, but holes may be drilled through the frame. For such models as those, FIG. 32 illustrates a support arm 19 that may be fixed to the frame of a skate by a rivet 39. The support arm of FIG. 32 would then be fitted to a housing as previously described with reference to FIG. 29.

The foregoing detailed description explains the five basic delivery mechanisms of the ground engaging movable brake of this invention, together with certain alternate embodiments of those delivery mechanisms. The foregoing description also introduced such other elements of this invention as the variable force mechanism, the arresting mechanism, the brake surface, and the actuator mechanism. With these five delivery mechanisms (rocker arm, carriage, plunger, side rail, and integrated unit) and related systems in mind, certain variations of the variable force mechanism will now be discussed.

Variable Force Mechanisms

The variable force mechanism of this invention enhances the operation of the delivery mechanisms. Among the specific embodiments of the variable force mechanism are those that incorporate a lever, a cam, a pulley, and/or a worm gear.

Previously Described Levers

It has already been explained with reference to the basic rocker arm delivery mechanism (see FIG. 1) that a lever end 30 of the rocker arm 22 serves as a variable force mechanism. Levers are also shown in the rocker arms that are included in the side rail delivery mechanism previously discussed (see rocker arm 22 in FIG. 13).

Previously Described Pulleys

Pulleys have been explained in connection with the basic carriage delivery mechanism (see pulley 84 in FIG. 6), and in the basic plunger delivery mechanism (see pulleys 84 and 130 in FIG. 10) previously discussed.

Previously Described Lever and Cam

A lever and cam arrangement has been explained in connection with the alternate carriage delivery mechanism (see lever 180 and cam 184 in FIGS. 14 and 15).

So also, the rocker arms of FIGS. 16A–16E all can be understood to use a lever action as the rocker arm rotates about the pivot point 23. These rocker arms can also be understood to involve a cam or a cam-like action when the cable 82 is set so as to pull about the circumference of the circular-shaped member of the rocker arm.

Previously Described Worm Gear and Take-Up Spool

A worm gear (reference FIG. 17A) and a take-up spool (reference FIG. 17B) have been explained in connection with the basic plunger delivery mechanism.

Arresting Mechanisms

The arresting mechanism of this invention provides an emergency back-up in the event that the delivery mechanism should fail. The most basic version of the arresting mechanism (already explained with reference to FIGS. 1–5 for the rocker arm delivery mechanism; FIGS. 6–9 for the carriage delivery mechanism; and FIG. 10 for the plunger delivery mechanism) is a post or bead disposed in the path of the delivery mechanism to lock the delivery mechanism in place so as to duplicate the action of a conventional toe-raised brake for emergency stopping.

FIGS. 18A–18G show several alternate ways of incorporating the arresting mechanism. For ease of reference, all of the arresting mechanisms will be shown with a rocker arm delivery mechanism, and each rocker arm, and the common elements of the various versions will be designated with identical numerals.

Figure 18A:
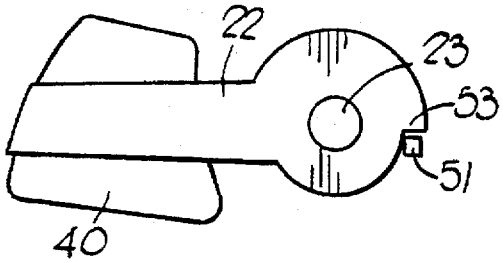

In FIG. 18A, the rocker arm 22 holds brake pad 40 at one end of the rocker arm. The other end of the rocker arm is circular in shape, having a pivot point 23. It can be understood that an actuator could urge the rocker arm to rotate about the pivot point so as to drive the brake pad 40 to the ground. In the event that the actuator should fail, it should be understood that the skater could raise the toe of the skate, rotating the rocker arm so that the brake pad 40 is brought to the ground.

Although the rocker arm will be able to rotate about the pivot point 23 for a small distance, a post 51 is so disposed in the path of travel that a ridge 53 on the end of the rocker arm will hit the post at a limit of rotation. At this limit, the travel of the rocker arm 22 about the pivot point will be arrested, the rocker arm will lock in to place, and the brake pad will be driven firmly into the ground. Thus the brake system of this invention can, in the event of an actuator failure, be made to simulate the action of a conventional toe-raised brake.

Figure 18B:
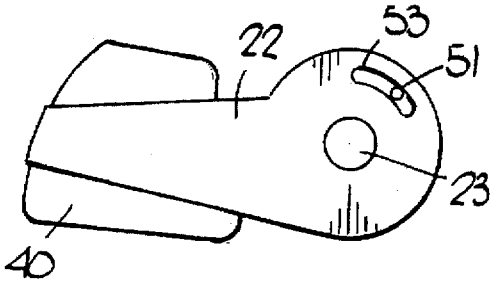

In FIG. 18B, the rocker arm 22 holds brake pad 40 at one end of the rocker arm. The other end of the rocker arm is circular in shape, having a pivot point 23. It can be understood that an actuator could urge the rocker arm to rotate about the pivot point so as to drive the brake pad 40 to the ground.

Although the rocker arm will be able to rotate about the pivot point 23 for a small distance, a post 51 is so disposed on the skate and in the path of travel of the rocker arm that a wall of cut-out 53 within the rocker arm will hit the post at a limit of rotation. At this limit, the travel of the rocker arm 22 about the pivot point will be arrested, the rocker arm will lock in to place.

Figure 18C:
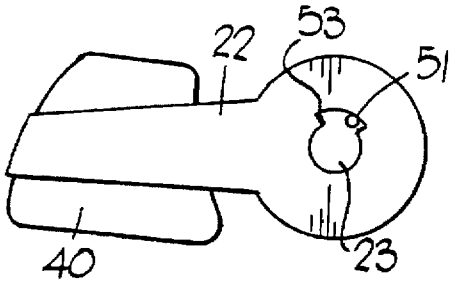
Figure 18D:
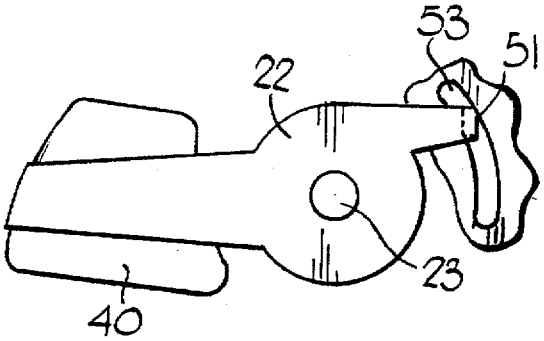

The arresting mechanisms of FIGS. 18C and 18D are variations on FIG. 18B.

In FIG. 18C, it can be seen that the cut-out 53 is oriented so as to be adjacent to the pivot point 23—a post 51 will hit the wall of cut-out 53 and lock the rocker arm.

In FIG. 18D, it can be seen that the cut-out 53 and post 51 are reversed from the arrangement of FIG. 18B. In the arresting mechanism of FIG. 18D, post 51 is an extension of the rocker arm and cut-out 51 is inscribed in the skate. As before, however, post 51 will hit the wall of cut-out 53 and lock the rocker arm.

Figure 18E:
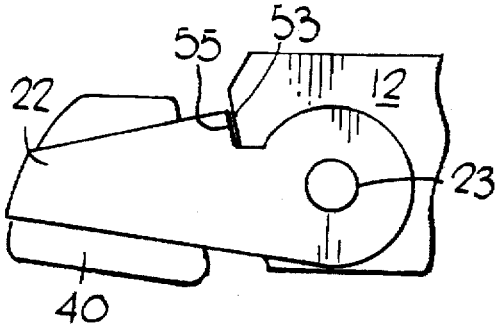
Figure 18F:
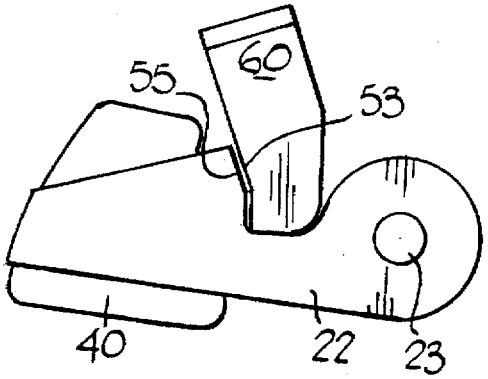
Figure 18G:
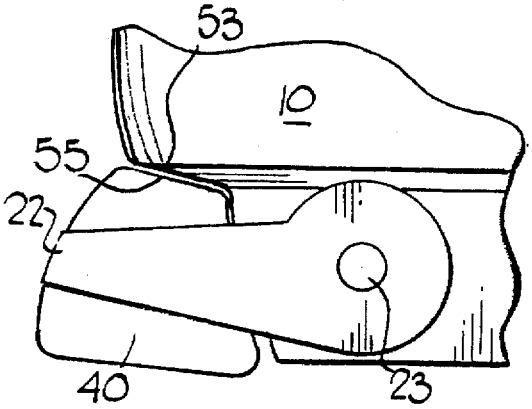

The arresting mechanisms of FIGS. 18E–18G are all variations involving the use of structures on the skate or skate frame to provide a fixed surface to lock the rocker arm into place.

In FIG. 18E, it can be seen that a surface 53 of the frame 12 of the skate can be oriented so as to be in the path of the rocker arm 22 so that a surface 55 of the rocker arm will hit surface 53 at a limit of rotation. As before, the rocker arm will be locked into place for emergency stopping.

In FIG. 18F, it can be seen that a surface 53 of the actuator arm 60 (see FIGS. 1, 5 and 6 for explanation of the actuator arm) of the brake system can be oriented so as to be in the path of the rocker arm 22 so that a surface 55 of the rocker arm will hit surface 53 at a limit of rotation. As before, the rocker arm will be locked into place for emergency stopping.

In FIG. 18G, it can be seen that a surface 53 of the skate boot 10 of the skate can be oriented so as to be in the path of the rocker arm 22 so that a surface 55 of the rocker arm will hit surface 53 at a limit of rotation. As before, the rocker arm will be locked into place for emergency stopping.

The foregoing description of the arresting mechanism of this invention is to be understood in light of adaptations readily apparent to those skilled in the art. In particular, and among other variations, it will be understood that the arresting mechanism is readily adapted for use with each of the delivery mechanisms of this invention. In all versions of the brake system of this invention, the arresting mechanism works so that, if the actuator should fail, the skater could raise the toe of the skate, rotating the rocker arm so that the brake pad 40 is brought to the ground, thereby simulating the working of a conventional toe-raised brake.

Brake Surfaces

The brake surface of the system of this invention is the element which is driven to the ground by the delivery mechanism. The most basic version of the brake surface is a pad, and this has been explained in connection with each of the delivery mechanisms so far discussed (for example, reference 40 in FIGS. 1–4, 6–9, 10–11, 13–16, 18, 23, and 24).

An alternative arrangement is the elliptical brake surface, in which a generally circular shape has eccentric radii so as to create an elliptical bulge which serves as a braking surface. This version has been discussed with reference to FIGS. 21, 22, and 29, and the direct application of this version to the surface of a rocker arm has been explained in connection with the discussion of FIGS. 16D and 16E.

In FIG. 19, yet another embodiment of the brake surface is shown. In a carriage type of delivery mechanism 20, having a lever arm 180 and support member 182, a friction-damped wheel 40A can be mounted. This carriage should be understood to work generally like the carriage structure of FIGS. 14 and 15, and the common elements will not be further discussed here. What sets the carriage of FIG. 19 apart is that the brake surface is a wheel 40A instead of the brake pad 40 used in the embodiment of FIGS. 14 and 15.

The advantage of the friction damped wheel is that the brake surface 40A can be made to rotate as it comes into contact with the ground. In a way roughly analogous to an antilock automobile brake, the rotation of brake surface 40A against the ground will provide a good braking action. The friction to wheel 40A could be generated by friction bearings having a predetermined load, a clamp axle, or a preloaded tension spring. These are all well known to those skilled in the art and will not be described further.

FIG. 20 shows a variation of the friction-damped wheel brake surface. A rocker arm 22 has a pivot point 23 and a pull point 25. Cable 82 attached to pull point 25 can rotate the rocker arm about the pivot point. In this embodiment, an end of the rocker arm holds axle 18 of a wheel 14A of a skate. The rocker arm 22 is so disposed that, when it rotates about pivot point 23, wheel 14A will be urged against another wheel 14B of the skate, thereby applying a rotating brake surface to stop the skate.

The foregoing description of the brake surface of this invention is to be understood in light of adaptations readily apparent to those skilled in the art. In particular, and among other variations, it will be understood that each brake surface is readily adapted for use with each of the delivery mechanisms of this invention. In all versions of the brake surface of this invention, a brake surface engages the ground and the brake surface moves in relation to the skate so that braking force is applied while the angle of the skate relative to the ground remains constant.

Actuator Mechanisms

The actuator mechanism is used to activate the delivery mechanism. Various versions of the actuator mechanism, with cables or with wireless components, and including a specially designed hand control, will be discussed.

The most basic actuator assembly is activated by a hand-held controller 90 (reference FIG. 25). To better accommodate the needs of a skater, this invention includes a VELCRO-brand hook and loop fastener 92 affixed to the controller 90, and a corresponding VELCRO-brand hook and loop fastener 94 which is placed on a belt 96. It can be seen that the skater may, when not holding the controller 90, readily place it on the belt 96 by the VELCRO-brand hook and loop fastenings. In addition, a holder clip 97 may be provided and the hand-held controller could be snapped into the clip.

For further convenience, and safety, the controller 90 is attached to the belt 96 by a strap 98. Strap 98 is designed to aid the skater in the event that the skater should drop the controller 90. Instead of dragging behind the skater on the ground, the controller 90 is retained by strap 98. The strap 98 may be made of elastic material in order that it may be relatively short (so that the controller 90 will be within reach if dropped) but also able to travel at arm's length (so that the skater will be able to hold the controller 90 at a comfortable distance from the body).

The hand-held controller 90 of FIG. 25 is a fairly standard item. One disadvantage is that it has an open handle so that the controller, if dropped, would easily snag posts or other stationary objects while the skater is still moving. This would create a sudden, and potentially unsafe stop. To address this concern, a specially designed hand-held controller is recommended for the system of this invention.

With reference to FIG. 26, it may be seen that a hand-held controller 300 has a trigger 302; a hand cam 304 rigidly attached to the trigger; a housing 306; a stand-off 308; an adjusting screw 310; a connector 312; and cable 82.

The trigger 302 and hand cam 304 are locked together and then seated within housing 306. Cable 82 is attached to connector 312, and adjustments are made by setting the stand off 308 and adjusting screw 310. All of this is well known to those in the art and will not be further discussed.

What is most significant about this hand-held controller 300 are these features: (a) the hand cam 304 and adjusting screw 310 allow every user to adjust the "feel" of the brake until he or she is satisfied with the brake action achieved with the pull of the controller trigger 302, and (b) the tension in the hand-held controller is such that when the trigger 302 is not actively being squeezed by the skater, it will be substantially covered by the housing 306, and will be "closed" rather than open. This last feature is meant to minimize the chance of a dropped controller snagging on a stationary object.

The "closed" orientation of the controller may be further understood by an inspection and comparison of FIGS. 26 and 27. In FIG. 27, the hand-held controller 300 just discussed is shown with the trigger 302 pulled, as a skater would do when squeezing on the trigger to activate the brake system. It can be seen that the trigger slides within a shelf (not separately numbered) at the top of the housing 306. By comparison, the controller of FIG. 26 is shown with the trigger 302 released, as when a skater is not touching the controller or is not activating the brake system. It can be seen that the trigger 302 is still substantially enclosed by the shelf and the rest of the housing 306. This safety feature is a reason for using a specially designed controller such as that of FIGS. 26 and 27 with the system of this invention, or with any remotely activated brake system.

While of the discussion so far has been in the context of a cable actuator, it should be apparent that the actuator need not be a cable-and-lever device. Because the cable can be seen as a drawback, it might be replaced by (a) a wireless electromechanical actuator, (b) a thin-wire electromechanical actuator.

In the wireless form, a radio-controlled method of activation is used. With reference to FIG. 28, it may be understood that a signal is sent to a solenoid 100 having a rod member 101 which activates rocker arm 22 (or equivalent element in the other delivery mechanisms shown). A spring 102 and spring tension adjuster 104 cooperate with the solenoid 100 to provide the forces in a first direction so as to bring the brake pad 40 into contact with the skating surface and in a second direction so as to carry the brake pad 40 above the skating surface when the brake is not engaged. A transmitter (not shown) may be carried in the skater's hand or on the waist with a battery pack or other power source attached to the skate, and the signal to activate the solenoid 100 is sent from the transmitter. The solenoid (and equivalent wireless controllers) is well known to persons skilled in the art, and will not be further described here.

In the thin-wire form (not separately shown), a transmitter and power source are attached to the skater's waist and a wire runs from the power source to a servomechanism on the skate which activates the rocker arm 22 (or equivalent structure in the other delivery mechanisms shown).

The foregoing descriptions of the actuator mechanism of this invention is to be understood in light of adaptations readily apparent to those skilled in the art. In particular, and among other variations, it will be understood that variations on the cable system include cable, wire, pneumatic, hydraulic, or electromagnetic elements. Likewise, an easily understood variation would be to reverse the push/pull orientation of the first and second forces of the actuator mechanism (that is, as discussed herein, a cable has been pulled to activate the delivery mechanism to drive the brake surface to the ground, and a spring has been used to push in the opposite direction—these actions could readily be reversed, if desired).

Method of Use

The method of use of the brake system of this invention will now be explained. The method includes using a delivery system to drive a brake surface against the ground to stop the skate, with the delivery system being hand-activated by a mechanical device so as to bring a brake surface that is operatively connected to the delivery system into contact with the skating surface. This method permits the skater to activate the brake without changing the angle of the skate itself relative to the ground—that is, the skater need not lift or lower the heel or toe of the skate. This method also permits the brake pad to contact the skating surface rather than the wheel of the skate.

The method of this invention further includes the option of using two brakes, one on each skate (or with the compact rocker arms of FIGS. 16D and 16E, with two or more brakes in tandem on a single skate), and includes using hook and loop devices, and straps, to secure the hand controls needed to activate the brake. An emergency braking method involves lifting the toe of the skate, using an arresting bar or bead to lock the delivery mechanism, so that the skate may then be stopped like a traditional toe-raised brake. All of the various components necessary to carry out this method have already been explained.

Method of Installing the Brake System on Skates

An important condition to achieving the advantages of the brake system of this invention is, of course, that the system must be capable of practical installation in an inline skate. Indeed, without a practical way either to retrofit existing skates or to fit newly manufactured skates, the objects of this invention would never be realized by skaters. Because of specific characteristics of this invention, a method for fitting the brake system disclosed herein both to existing inline skates and to newly manufactured skates can be readily devised, and is disclosed as part of this invention.

The system of this invention also includes a method for retrofitting the brake to an existing skate. This retrofit method includes removing the axle bolts from the rear wheel of an existing skate; placing an element of the delivery mechanism or the brake surface itself over the axle; and then replacing the axle bolts so as to secure the system in place.

As has already been explained, the rocker arm pivot point (for example, the pivot point as shown in FIG. 1); the carriage delivery mechanism pivot point (as shown in FIGS. 6, 14, 15, and 19); the plunger housing support arm (support arm 132 in FIG. 10); and the side rail (side rail 150 in FIG. 11) all are designed to be fitted to a skate over the axle of the wheels.

An alternate method of retrofit involves removing a fixed brake pad from a fixed housing (such as housing 13 in FIG. 22) and setting a ground engaging movable brake within the housing in its place. This has been explained in connection with FIG. 22.

Additional retrofit options are provided by the alternate integrated delivery system previously discussed in connection with FIG. 29. In that case, a housing (housing 15 in FIG. 29) is attached to the frame of a skate, as already explained.

Further retrofit options are understood in light of the ability to place a rocker arm or other delivery mechanism away from the axle of a wheel, but upon an axle parallel to an axle of the wheel. The side rail of FIG. 13 and the rocker arm of FIG. 24 are two examples.

It is just as easy, and perhaps easier, to place the system of this invention on a newly manufactured skate, using any of the techniques just discussed, but without the need to first remove an existing element on the skate.

In summary, the brake system of this invention is remotely activated, uses the skating surface (rather than a wheel of the skate) for generating stopping force while the angle of the skate relative to the ground remains constant, has a large effective area in contact with the skating surface, can be fitted to both skates, allows for an independent selection of the material in contact with the braking surface, incorporates an emergency brake, can be readily installed in new or used skates, and conveniently retains all cables and hand-levers which are a part of the system.

It should be well understood that each of the several delivery mechanisms, variable force mechanisms, arresting mechanisms, brake surfaces, and actuators may be combined with each of the other components to provide a very large number of specific combinations. Although this disclosure has specifically described many combinations, it is not intended that the combinations described should be taken to be the only ones claimed in this invention. Instead, those specifically described combinations are meant to show the breadth of the system of this invention and broadly to enable other combinations, all within the scope of this invention.

What is claimed is:

1. A skate brake system for a skate having a longitudinally-extending frame with a plurality of axles which support a plurality of wheels, the system comprising:

a support element pivotally connected to one of said axles and extending rearwardly with respect to the frame;

at least one brake pad operably connected to said support element, said brake pad having a braking surface adapted to interact with the ground; and at least one rod member having a first end and a second end, said rod member connected to said support element at said second end such that when the first end of said rod member is pushed said braking surface of said brake pad is moved into ground engagement and when the rod member is pulled said braking surface of said brake is moved away from ground engagement.

2. A system as in claim 1, wherein said support element comprises a carriage having at least one arm which is pivotally connected to one of said axles.

3. A system as in claim 1, wherein said support element is pivotally connected to a rearmost one of said axles.

4. A system as in claim 1, further comprising a solenoid, wherein said first end of said rod member is received within said solenoid to push and pull said rod member upon actuation of said solenoid.

5. A roller skate system, comprising:

a roller skate having a frame with a front end and a rear end and a shoe or a boot fixedly attached to the frame, the skate further including a plurality of wheels which are attached to the frame by axles;

a brake pivotally connected to one of said axles such that the brake is pivotable about said axle, the brake having a braking surface which extends rearwardly from the rear end of the skate so as to be behind a rearmost wheel, the brake having a first position where the braking surface is above a skating surface and having a second position where the braking surface is in contact with the skating surface; and at least one rod member having a first end and a second end, wherein said first end is operably attached to said skate and said second end is operably attached to said brake such that pushing of the first end of said rod member causes the brake to move from the first position to the second position while the angle of the skate relative to the skating surface remains constant and while the shoe or the boot remains fixedly attached to the frame, and with the brake engaging the skating surface to slow or stop the roller skate when in the second position.

6. A system as in claim 5, wherein pulling of the first end of said rod member causes the brake to move away from the second position to disengage the brake from the skating surface.

7. A system as in claim 6, further comprising a solenoid which is directly attached to said skate, wherein said first end of said rod member is received within said solenoid to push and pull said rod member upon actuation of said solenoid.

8. A system as in claim 5, wherein said brake further comprises a carriage having at least one arm which is pivotally connected to one of said axles.

9. A system as in claim 5, wherein said brake is pivotally connected to a rearmost one of said axles.

10. A method for stopping a roller skate comprising a shoe or a boot which is fixedly attached to a frame, said skate further comprising a plurality of wheels which are each attached to said frame by an axle, said method comprising:

providing a support element having a braking pad operably attached thereto, wherein said support element is pivotally attached to one of said axles such that said braking pad is positioned behind a rearmost one of said wheels;

providing a rod member having a first end and a second end, with the second end being operably attached to the support element;

skating on said roller skate over a skating surface;

pushing on the first end of said rod member while skating and while an angle of a skater's foot relative to the skating surface remains constant to pivot said support element about said axle until said braking pad engages the skating surface.

11. A method as in claim 10, further comprising pulling on the first end of said rod member while skating and while the angle of the skater's foot relative to the skating surface remains constant to pivot said support element about said axle until said braking pad disengages the skating surface.

12. A method as in claim 10, wherein said support element comprises a carriage having at least one arm which is pivotally connected to one of said axles.

13. A method as in claim 10, wherein said support element is pivotally connected to a rearmost one of said axles.

14. A method as in claim 10, further comprising providing a solenoid into which said first end of said rod is received, and wherein said rod member is pushed and pulled by actuating said solenoid.

15. A method for stopping a roller skater comprising:

providing a skate comprising a shoe or a boot which is fixedly attached to a frame, said skate-further comprising a plurality of wheels which are each attached to said frame by an axle;

providing a support element having a braking pad operably attached thereto, wherein said support element is pivotally attached to one of said axles such that said braking pad is positioned behind a rearmost one of said wheels;

providing a rod member having a first end and a second end, with the second end being operably attached to the support element;

skating on said skate over a skating surface;

pushing on the first end of said rod member generally in a direction of the second end while skating and while the angle of a skater's foot relative to the skating surface remains constant to pivot said support element about said axle until said braking pad engages the skating surface.

16. A method as in claim 15, further comprising pulling on the first end of said rod member while skating and while the angle of the skater's foot relative to the skating surface remains constant to pivot said support element about said axle until said braking pad disengages the skating surface.

17. A method as in claim 15, wherein said support element comprises a carriage having at least one arm which is pivotally connected to one of said axles.

18. A method as in claim 15, wherein said support element is pivotally connected to a rearmost one of said axles.

19. A method as in claim 15, further comprising providing a solenoid into which said first end of said rod is received, and wherein said rod member is pushed and pulled by actuating said solenoid.

20. A method for stopping a roller skater comprising:

providing a skate comprising a shoe or a boot which is fixedly attached to a frame, said skate further comprising a plurality of wheels which are each attached to said frame by an axle;

providing a support element having a braking pad operably attached thereto, wherein said support element is pivotally attached to one of said axles such that said braking pad is positioned behind a rearmost one of said wheels;

providing a rod member having a first end and a second end, with the second end being operably attached to the support element;

skating on said roller skate over a skating surface;

pushing on the first end of said rod member to move the second end of said rod member, wherein movement of said second end by pushing on said first end causes said second end to push the support element, thereby moving at least a portion of the support element toward the skating surface while skating and while the angle of the skater's foot relative to the skating surface remains constant, said support element further pivoting about said axle until said braking pad engages the skating surface.

21. A method as in claim 20, further comprising pulling on the first end of said rod member while skating and while the angle of the skater's foot relative to the skating surface remains constant to pivot said support element about said axle until said braking pad disengages the skating surface.

22. A method as in claim 20, wherein said support element comprises a carriage having at least one arm which is pivotally connected to one of said axles.

23. A method as in claim 20, wherein said support element is pivotally connected to a rearmost one of said axles.

24. A method as in claim 20, further comprising providing a solenoid into which said first end of said rod is received, and wherein said rod member is pushed and pulled by actuating said solenoid.

* * * * *